US011885584B2

(12) United States Patent
Call et al.

(10) Patent No.: US 11,885,584 B2
(45) **Date of Patent: *Jan. 30, 2024**

(54) MULTI-SHOT AIRGUN

(71) Applicant: Crosman Corporation, Bloomfield, NY (US)

(72) Inventors: Kenneth A. Call, Rush, NY (US); Jeffrey D. Hanson, Honeyoye Falls, NY (US); Eric A. St. Phillips, Fairport, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/739,518

(22) Filed: May 9, 2022

(65) Prior Publication Data

US 2022/0341701 A1 Oct. 27, 2022

Related U.S. Application Data

(63) Continuation of application No. 17/153,661, filed on Jan. 20, 2021, now Pat. No. 11,353,282.

(60) Provisional application No. 62/964,498, filed on Jan. 22, 2020.

(51) Int. Cl.
*F41B 11/648* (2013.01)
*F41B 11/73* (2013.01)
*F41B 11/55* (2013.01)

(52) U.S. Cl.
CPC ..... *F41B 11/648* (2013.01); *F41B 11/55* (2013.01); *F41B 11/73* (2013.01)

(58) Field of Classification Search
CPC ..... F41B 11/54; F41B 11/55; F41B 11/642; F41B 11/646; F41B 11/647; F41B 11/648; F41B 11/73
USPC ..... 124/56, 71, 72, 73, 76
See application file for complete search history.

(56) References Cited

U.S. PATENT DOCUMENTS

| | | | |
|---|---|---|---|
| 836,532 | A | 11/1906 | Picken |
| 2,962,017 | A | 11/1960 | Horowitz et al. |
| 3,782,359 | A | 1/1974 | Kester et al. |
| 3,913,553 | A | 10/1975 | Braughler et al. |
| 4,422,433 | A | 12/1983 | Milliman |
| 4,986,251 | A | 1/1991 | Lilley |
| 5,150,701 | A | 9/1992 | Wackrow et al. |
| 5,280,778 | A | 1/1994 | Kotsiopoulos |
| 5,511,333 | A | 4/1996 | Farrell |

(Continued)

FOREIGN PATENT DOCUMENTS

KR 101401865 B1 5/2014

OTHER PUBLICATIONS

Office Action for U.S. Appl. No. 17/153,612 dated May 28, 2021, Kowalczyk, John "Airgun Magazine" 7 pages.

(Continued)

*Primary Examiner* — Bret Hayes
(74) *Attorney, Agent, or Firm* — Lee & Hayes P.C.

(57) ABSTRACT

An airgun for use with a projectile supply is described. A cam surface of the airgun and a bolt positioner of the airgun are configured so that rotation from a firing position to a reloading position causes a cam surface of the airgun to drive the bolt positioner through a passageway of the projectile supply to drive a projectile in the passageway to a position where pressurized gas in the firing location will thrust the projectile through the bore.

15 Claims, 22 Drawing Sheets

(56) References Cited

U.S. PATENT DOCUMENTS

| | | | | |
|---|---|---|---|---|
| 5,845,629 | A | 12/1998 | Ratliff | |
| 6,470,871 | B2 | 10/2002 | Casas-Salva | |
| 7,159,584 | B2 | 1/2007 | Maeda et al. | |
| 7,395,763 | B1 | 7/2008 | Vari | |
| 8,931,467 | B2 | 1/2015 | Lee | |
| 9,134,090 | B1 | 9/2015 | Park | |
| 10,066,896 | B2 | 9/2018 | Zhu | |
| 10,197,355 | B2 | 2/2019 | Lamboy | |
| 10,267,593 | B2 | 4/2019 | Lamboy | |
| 11,002,508 | B2 | 5/2021 | Miller et al. | |
| 11,098,976 | B2 | 8/2021 | Call | |
| 11,353,279 | B2 | 6/2022 | Chia | |
| 11,353,282 | B2 * | 6/2022 | Call | F41B 11/55 |
| 2003/0094167 | A1 | 5/2003 | Nibecker, Jr. | |
| 2005/0072415 | A1 | 4/2005 | Schavone | |
| 2010/0229844 | A1 | 9/2010 | Gore | |
| 2014/0331855 | A1 | 11/2014 | Hanson | |
| 2019/0383575 | A1 | 12/2019 | Chia | |
| 2020/0096287 | A1 | 3/2020 | Miller et al. | |
| 2020/0232749 | A1 | 7/2020 | Call | |
| 2020/0263950 | A1 | 8/2020 | Call | |
| 2021/0222991 | A1 | 7/2021 | Kowalczyk, Jr. et al. | |
| 2021/0318095 | A1 | 10/2021 | Call et al. | |

OTHER PUBLICATIONS

Office Action for U.S. Appl. No. 17/153,661, dated Oct. 6, 2021, Call, "Multi-Shot Airgun", 5 Pages.

The PCT Search Report and Written Opinion dated Mar. 25, 2021 for PCT application No. PCT/US21/14328, 11 pages.

The International Search Report and Written Opinion for PCT Application No. PCT/US21/14331, dated Oct. 7, 2021.

* cited by examiner

MULTI-SHOT AIRGUN

CROSS REFERENCE TO RELATED APPLICATIONS

This patent application is a continuation of and claims priority to U.S. patent application Ser. No. 17/153,661, filed Jan. 20, 2021, which claims priority to U.S. Provisional Patent Application No. 62/964,498, filed Jan. 22, 2020, which are fully incorporated herein by reference.

FIELD OF THE INVENTION

Airguns of the break barrel type.

BACKGROUND OF THE INVENTION

Conventional break barrel air guns provide a stock and receiver that are joined to a barrel by way of a hinge. The receiver houses a spring into which energy is stored, a trigger for releasing the stored energy of the spring to drive a piston into a compression tube having a transfer port that communicates pressure from the compression tube to a breech end of the barrel. In such air guns, the barrel is hingedly joined to the receiver. When the user wishes to use the break barrel airgun, the user rotates the barrel relative to the stock and receiver. This separates the breech end of the barrel from the transfer port allowing a pellet to be loaded therein. After loading the user rotates the barrel to a position where the breech end of the barrel is positioned proximate to the transfer port. The barrel is also connected to the spring in a manner that causes the energy to be stored in the spring as the break barrel is moved during the loading process.

While the acts of rotating the barrel to and from the loading position can be conducted rather quickly. The process of manually loading an individual pellet into the breech end of a barrel while holding an air rifle can be challenging and can extend the time between shots significantly.

What is needed is a break barrel airgun that can load pellets automatically during the cocking action. This need is particularly challenging to meet in that the cocking action of a break barrel rifle separates the barrel from the breech and loading must therefore occur during such separation.

This need has been long felt and efforts have been made to meet this need by using elevator systems that receive a projectile from a magazine using a loading mechanism located above the bore axis of a barrel bore to load a projectile into an elevator that is lowered into the air gun to form a segment of a path between a tube transfer port and the bore of an airgun. Examples of such approaches are shown in U.S. Pat. No. 5,722,382, entitled "Loading Plate for a Repeat-Air Rifle for Pellets and Ammunition" issued Orozco, on Mar. 3, 1998 and ES1007337U, entitled, in translation "Charging Mechanism for Compressed Air Carabines".

It will be appreciated that such elevator type systems require that the projectile be loaded perfectly within a length of the elevator to prevent the projectile from jamming the elevator as the projectile is lowered into general alignment with the axis of the barrel bore. Further, misalignment of the elevators with the axis of the bore can cause portions of a projectile to impact edges of the barrel leading to variations in projectile geometries if fired from the rifle and may also lead to jamming. Additionally, such solutions involve firing compressed air through the elevator. To avoid loss of energy in an elevator type system, two seals must be maintained during firing one between the elevator and the transfer port and the other between the elevator and the bore of the barrel. These seals must be arranged release during cocking to allow the barrel to tilt away and elevator to shuttle between a firing position and a loading position during cocking and to return to a sealed position for firing. However, such approaches add cost, weight, and complexity which may not be useful in field environments.

Efforts to address these challenges include providing user adjustment controls to help establish and maintain proper alignment between the elevator and the bore have been described in GB978,502 entitled "Improvements in or relating to Air or Gas Pressure Guns" issued to Vesely et al., and published on Dec. 23, 1964. However, this approach requires constant adjustments and creates usability problems.

Additionally, such solutions involve firing compressed air through the elevator. To avoid loss of energy in an elevator type system, two seals must be maintained during firing one between the elevator and the transfer port and the other between the elevator and the bore of the barrel. These seals must be arranged release during cocking to allow the barrel to tilt away and elevator to shuttle between a firing position and a loading position during cocking and to return to a sealed position for firing.

Such seals are typically made using a conformal material to ensure good sealing properties when compressed, however such seals are also vulnerable to damage when exposed to non-compressive loads—such as frictional loads that may arise as the elevator slides from the firing position to the loading position. This can damage seals confronting the elevator allowing compressed air to leak during firing which has the effect of lowering the amount of energy available to propel a projectile. Lowered energy reduces shot velocity and projectile spin rates which can make it more difficult for the user to predict the point of impact These and other challenges have made it difficult to provide an break barrel rifle having a shoot-through elevator type loading system that can achieve a high rate of accurate fire.

One alternative to the shoot-through elevator approach is to use a load and retract mechanism to load the projectile into the barrel while the barrel is separated from the transfer port during cocking and to retract the loading mechanism so that the barrel and transfer port close against each other directly. In one example of this type sold by Gamo Industrias shown in FIG. 1, uses a load and retract mechanism 2 mounted over a barrel 11. The load and retract type mechanism 2 has a loader 3 arranged proximate to, but above, a breech opening of the barrel when the barrel and transfer port are arranged for firing projectiles.

During cocking, components of rifle 1 are moved from the firing position shown to a cocking position where the breech and barrel are separated. As this occurs, the load and retract mechanism 2 moves loader 3 from a position above a barrel bore 4 downwardly to a position adjacent the barrel bore 4 so that loader 3 can place the projectile in the barrel bore. As the barrel is returned to the firing position, load and retract mechanism 2 raises loader 3 to a position above barrel bore 4 so that loader 3 is not caught between the breech and the barrel as these components are closed against each other.

Hatsan Arms Company, Izmir, Turkey has also introduced a break-barrel rifle 6 having a load and retract mechanism. One example of this, the Hatsan SpeedFire Vortex multi-shot breakbarrel air rifle is shown in FIG. 2 with portions of a stock and barrel cut away. This automatically loading break barrel rifle 6 has a downwardly extending pivot type mechanism 7 mounted above a barrel bore axis 8. When the breech is closed against the barrel as shown in FIG. 2, a loader 9 is positioned by pivot type mechanism 7 proximate to, but above, barrel bore axis 8. As components of the break-barrel rifle 6, are moved from the closed position shown to a cocking position whereat the breech and barrel are separated, pivot type mechanism 7 downwardly pivots the loader 9 from a position above barrel bore axis 8 to a position adjacent the barrel bore axis 8 so that loader 9 can place the projectile in the barrel bore. As the barrel is returned to the firing position, pivot type mechanism 7 raises loader 9 to a position above bore axis 8 so that loader 9 is not caught between the breech and the barrel as these components are closed against each other. This system also requires a significant bore axis separation H between the axis 8 of the barrel and an axis 5 of an aiming device.

It will be appreciated that such load and retract solutions require mechanisms are mounted above the barrel of the airgun that substantially block the field of view of a shooter within a range of positions above the bore axis of the respective gun. These ranges are illustrated in FIGS. 1 and 2 as range G and range H respectively. In such systems, aiming is accomplished by positioning aiming sights generally above the loading mechanisms. This however, requires a significant vertical separation between the aiming axis and the axis of the bore. This separation creates parallax problems that require advanced aiming adjustments that few casual shooters master. This separation also requires mountings that can rigidly hold aiming devices in fixed relation over significant distances. This creates snag hazards increases the risk of damage or misalignment of the sights due to incidental contact, and adds weight, complexity and cost.

Such downward reaching loading solutions require a substantial number of parts, all of which must be located above the barrel during firing. Further, such downward reaching solutions necessarily require weather proofing and robustness features. Such solutions, therefore, are large, complex, add weight, add cost, are exposed to environmental conditions and add snag risks.

Thus what is needed is an airgun that provides autoloading capabilities without introducing the aiming, cost and complexity complications of existing systems. Further what is needed is an airgun that can meet such requirements while preserving the conventional aesthetics of an airgun.

Additionally, automatic loading is addresses one challenge in the use of such airguns. However, the challenges of providing a rifle and projectile storage device that enables quick and effective user insertion and removal of projectile storage systems such as magazines also influences overall satisfaction with the airgun experience and is not addressed by the existing automatic loading solutions.

DESCRIPTION OF THE INVENTION

Figure 1:
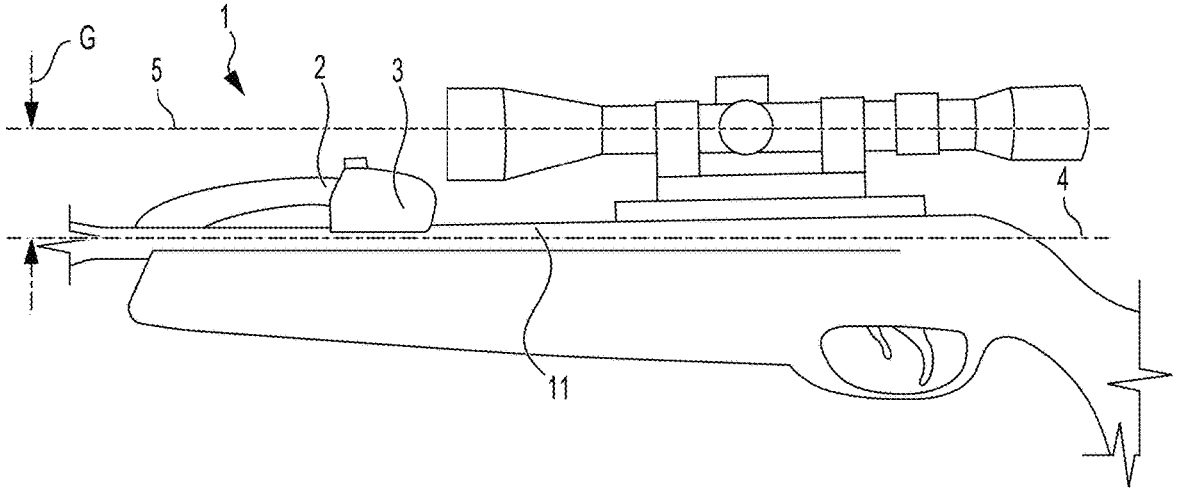
FIG. 1 (PRIOR ART)
FIG. 1 is a left side view of a downward reaching automatic loading break barrel rifle of the prior art with portions of a stock and barrel cut away.
Figure 2:
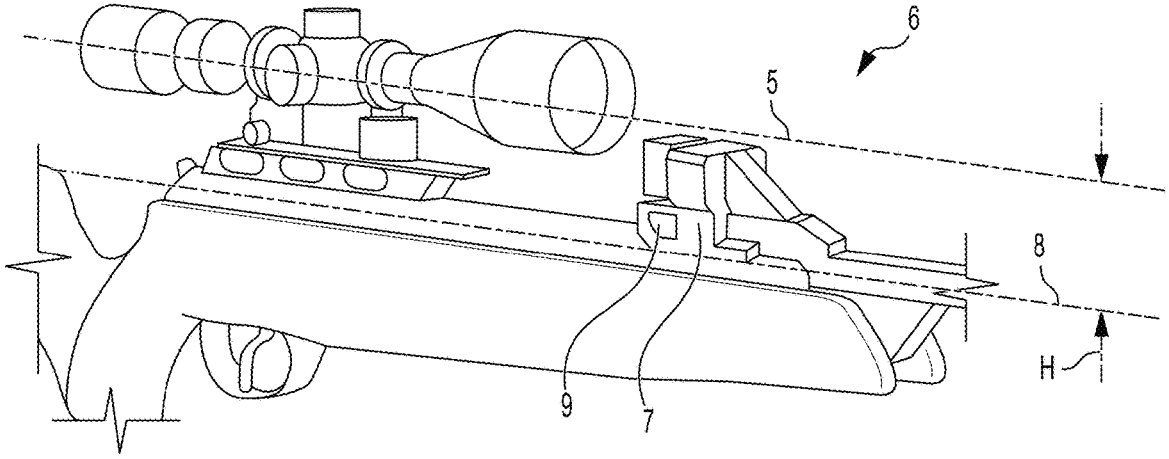
FIG. 2 (PRIOR ART)
FIG. 2 is a left side view of a downward reaching automatic loading break barrel rifle of the prior art with portions of a stock and barrel cut away.
Figure 3:
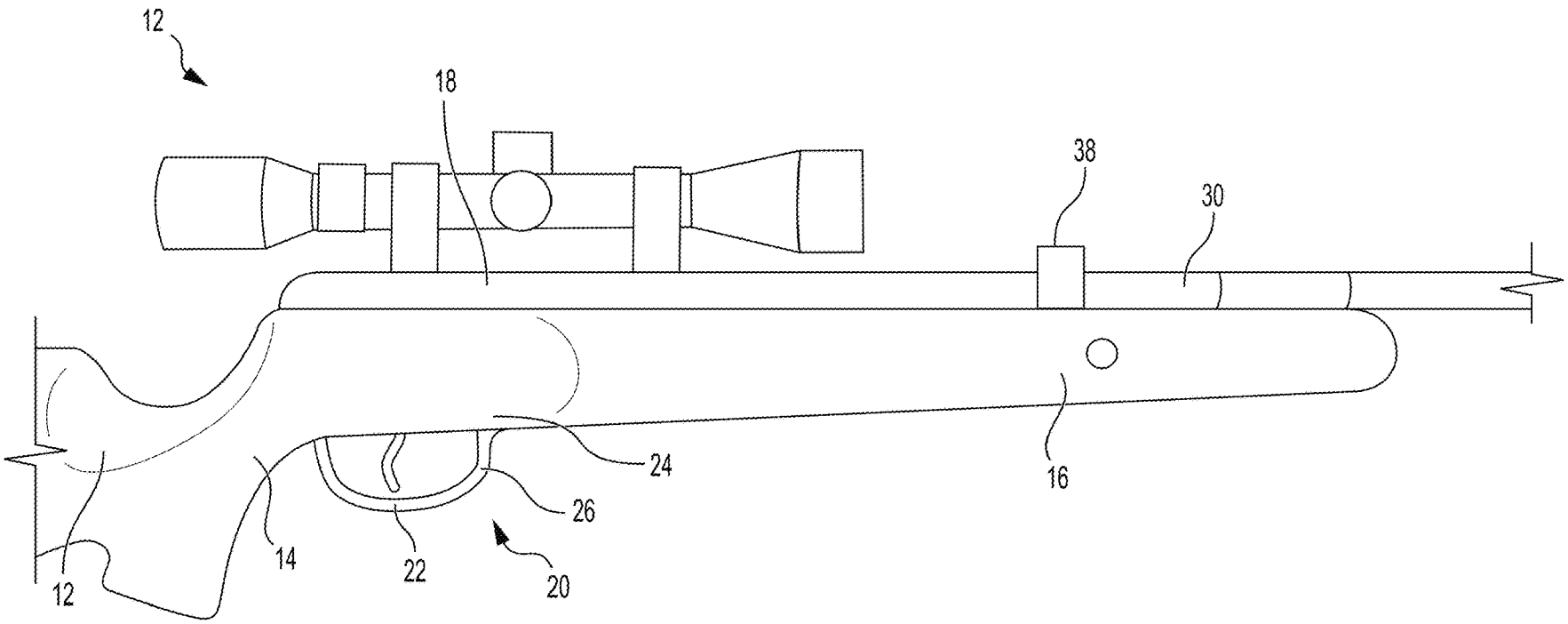
FIG. 3 is a right side partial view of one embodiment of an airgun automatic loading system with portions of a stock and barrel cut away and a magazine type projectile loading system.
Figure 4:
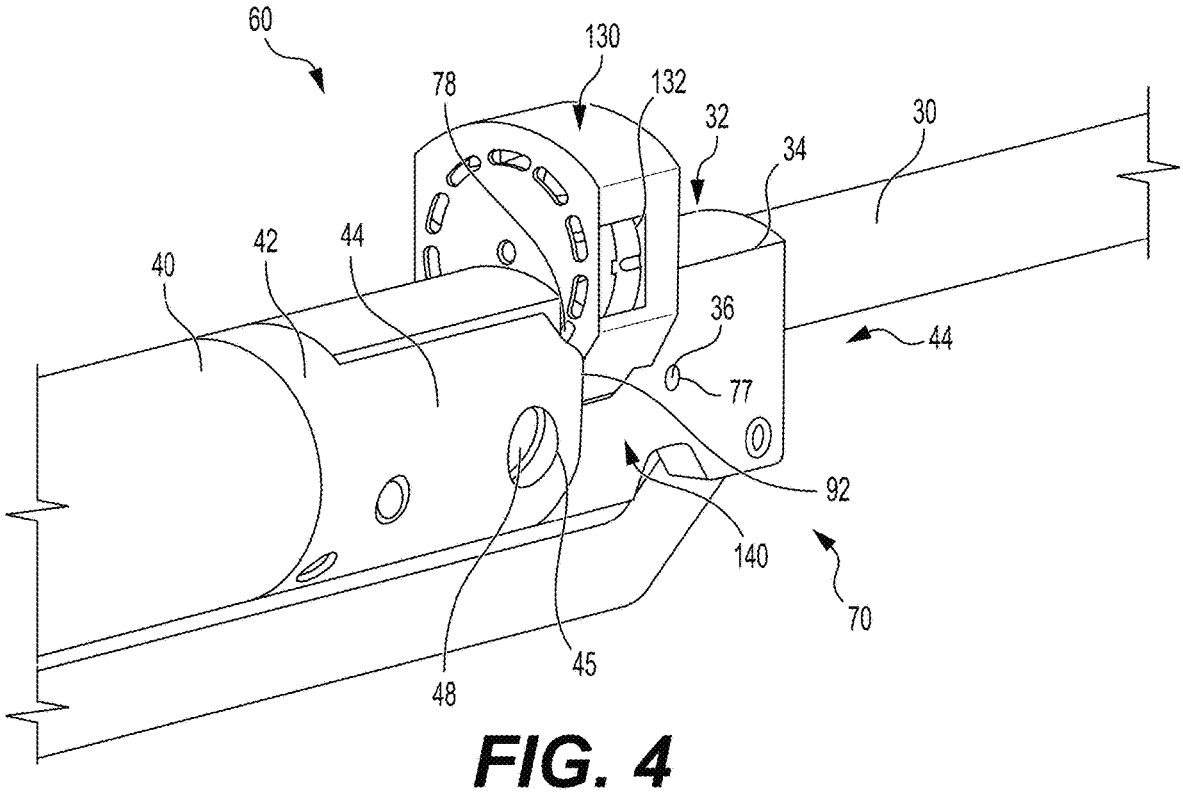
FIG. 4 is a back, top, right side perspective view of an automatic loading system with portions of a tube, barrel and cocking arm cut away.
Figure 5:
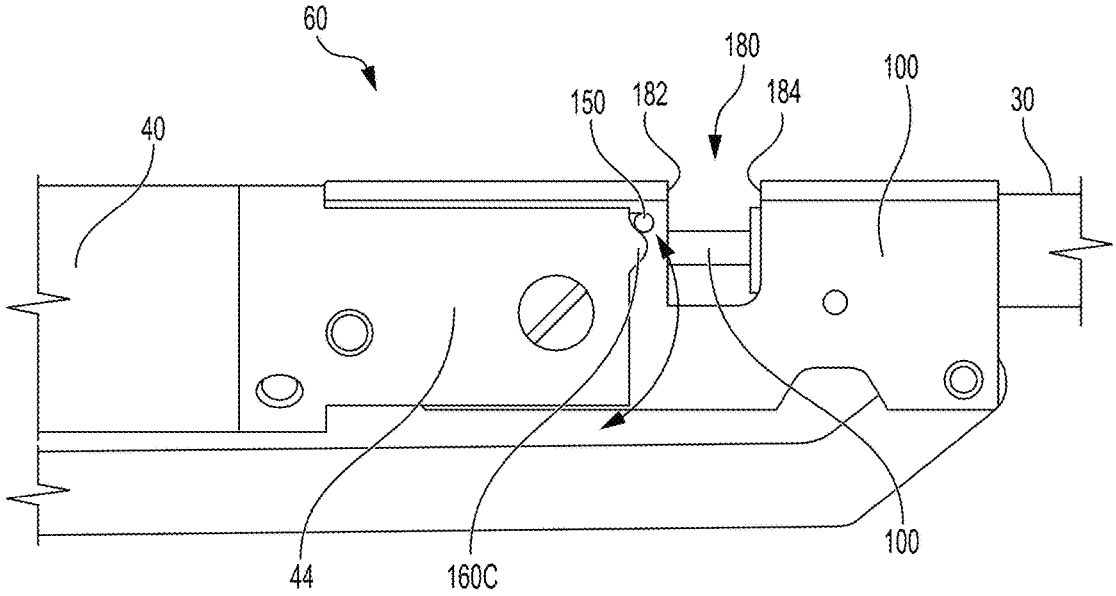
FIG. 5 is a right elevation view of the embodiment of the automatic loading system of FIG. 3 without a projectile loading system holder and with portions of a breech, tube forks and barrel cut away.
Figure 6:
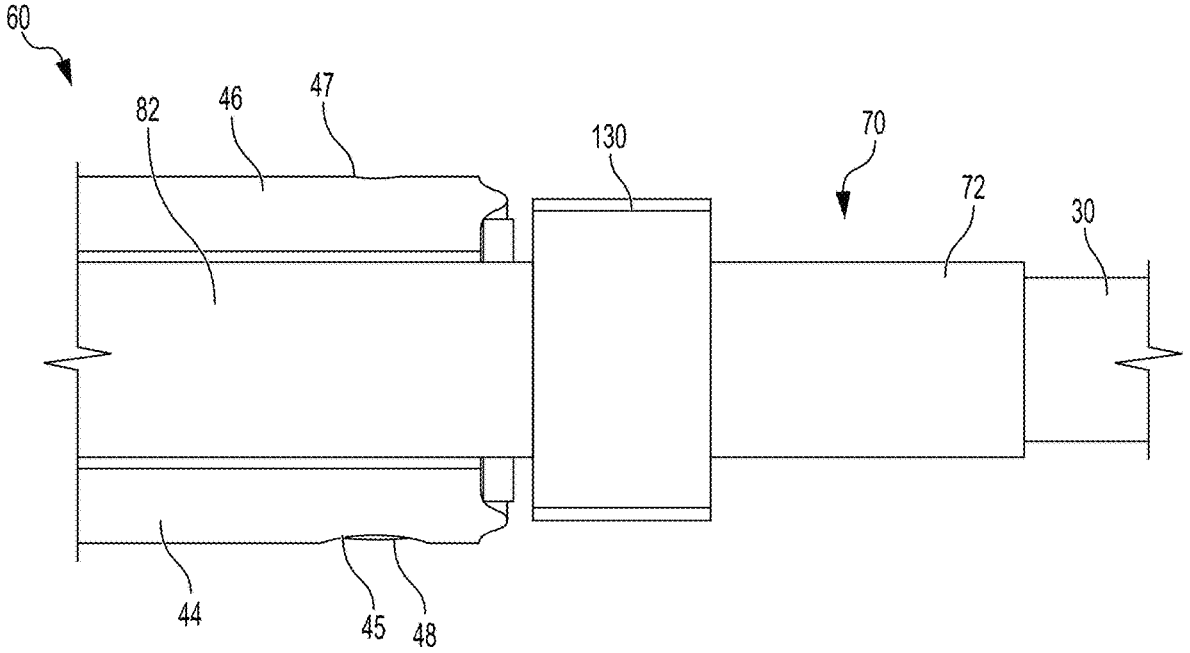
FIG. 6 is a top view of the embodiment of the automatic loading system of FIG. 3 with a bolt in a firing orientation and with projectile holding system hidden.
Figure 7:
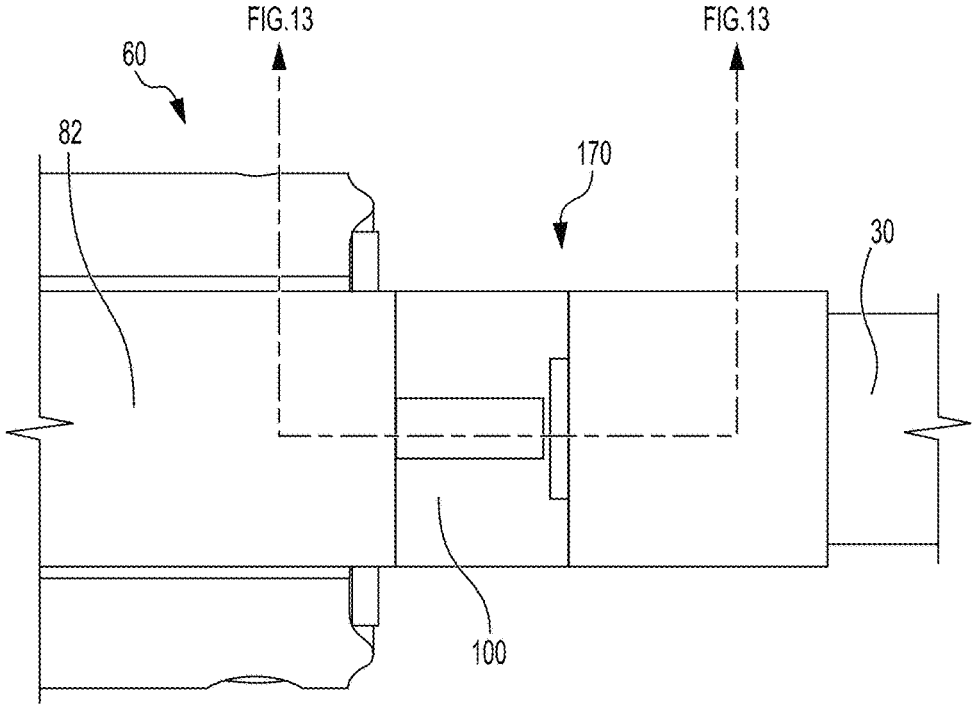
FIG. 7 is a side cross-section view of the of the embodiment of automatic loading system of FIG. 3 in the firing position with a forestock removed and portions of other components cut away.

FIG. 3 is a right side partial view of one embodiment of an airgun 10 of automatic loading system with portions of a stock and barrel cut away and a magazine type projectile loading system. FIG. 4 is a back, top right side perspective view of an automatic loading system with portions of a tube, barrel and cocking arm cut away. FIG. 5 is a right elevation view of the embodiment of the automatic loading system of FIG. 3 with a bolt in a firing orientation and with a projectile holder hidden. FIG. 6 is a top view of the embodiment of automatic loading system of FIG. 3 with a projectile supply. FIG. 7 is a top view of the embodiment of automatic loading system 60 without a projectile supply.

As is shown in FIG. 3, airgun 10 has a stock 12 with a grip handle 14, forestock 16, mounting rail 18, a trigger system 20, with a trigger 22, a safety 24 and trigger guard 26. Airgun 10 also has a barrel 30 through which projectiles such as pellets are thrust toward a target.

As is shown in FIGS. 4-7, a compression tube 40 is connected to barrel 30 in a manner that permits compression tube 40 and barrel 30 to be moved relative to each other between a firing orientation shown in FIGS. 3-10 and a cocking orientation. In this embodiment, compression tube 40 has a tube end 2 with a first fork 44 and a second fork 46 separated from first fork 44. First fork 44 has a first pivot mount 45 and second fork 46 has a second pivot mount 47 mechanically associated therewith that connect to a pivot 48 extending across the separation between first fork 44 and second fork 46.

Also connected to pivot 8 is a breech 70. The features of breech 70 will be described in greater detail below; however, as is illustrated in FIGS. 4-7, breech has a barrel mount 72 that holds barrel 30, a bolt guide 82 and a projectile supply positioner 170. Projectile supply holder positioner is positioned between barrel 30 and bolt guide 82 and is shown having a bolt side surface 172, a barrel side surface 174 and a bottom surface 178 adapted to hold a projectile supply 130. Bolt guide 82 provides surfaces to guide a bolt 100 for movement into and out of projectile supply holder positioned and barrel 30.

In embodiments, automatic loading system 60 may comprise a breech 70 with a bolt guide 82, a bolt 100, a bolt positioner 78, a cam surface 92, a biasing system 120 and a projectile older 132. These features will now be discussed in greater detail with reference to FIG. 8 which is a partial cross-section view of a portion of airgun 10 including automatic loading system 60 of the embodiment of FIG. 3 and FIG. 9 is a partial top, front, right side perspective view of automatic loading system 60.

Figure 8:
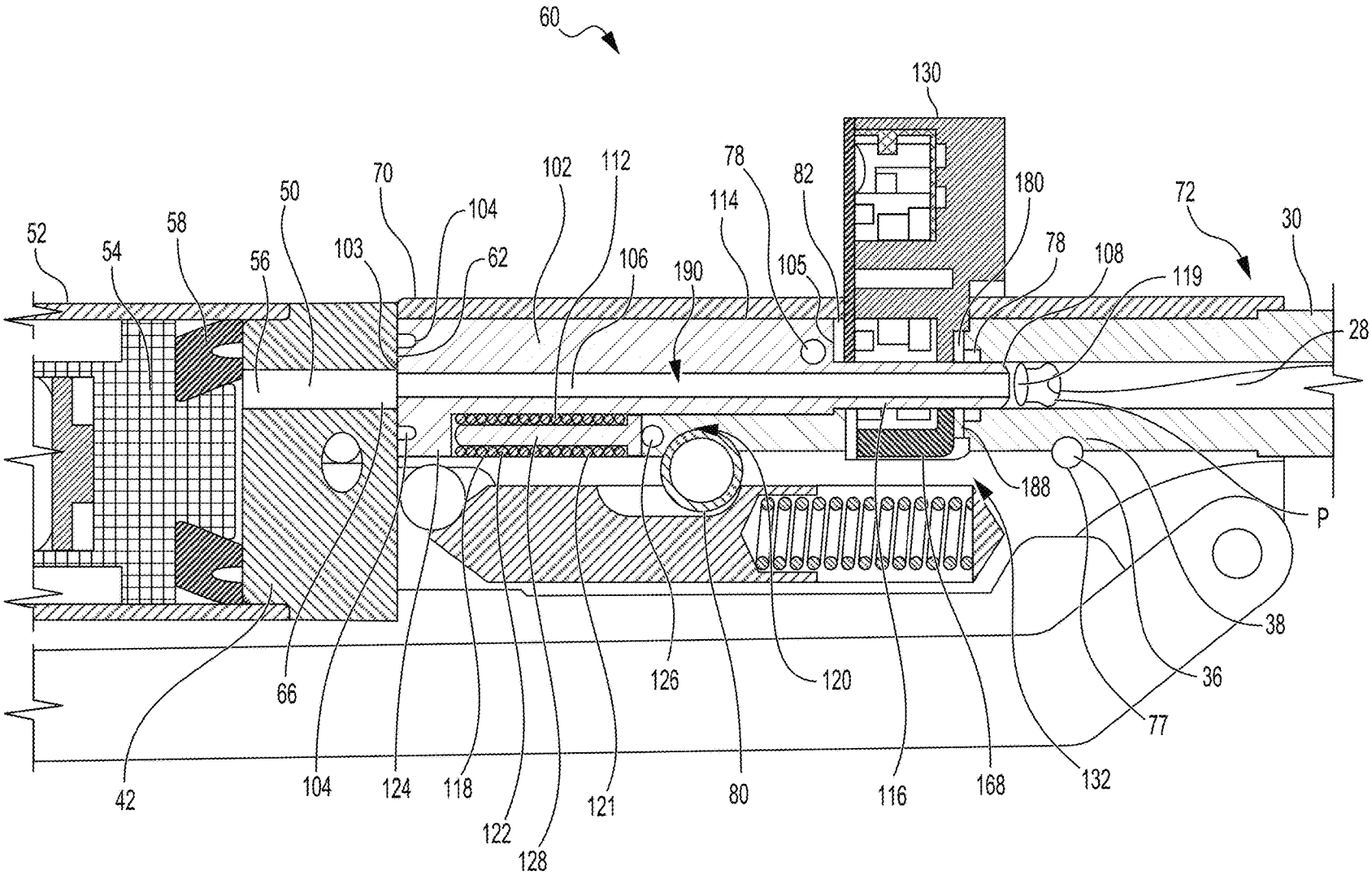
FIG. 8 is a partial cross-section view of the automatic loading system of FIG. 3 in the firing position but with no projectile storage device in the magazine holder.
Figure 9:
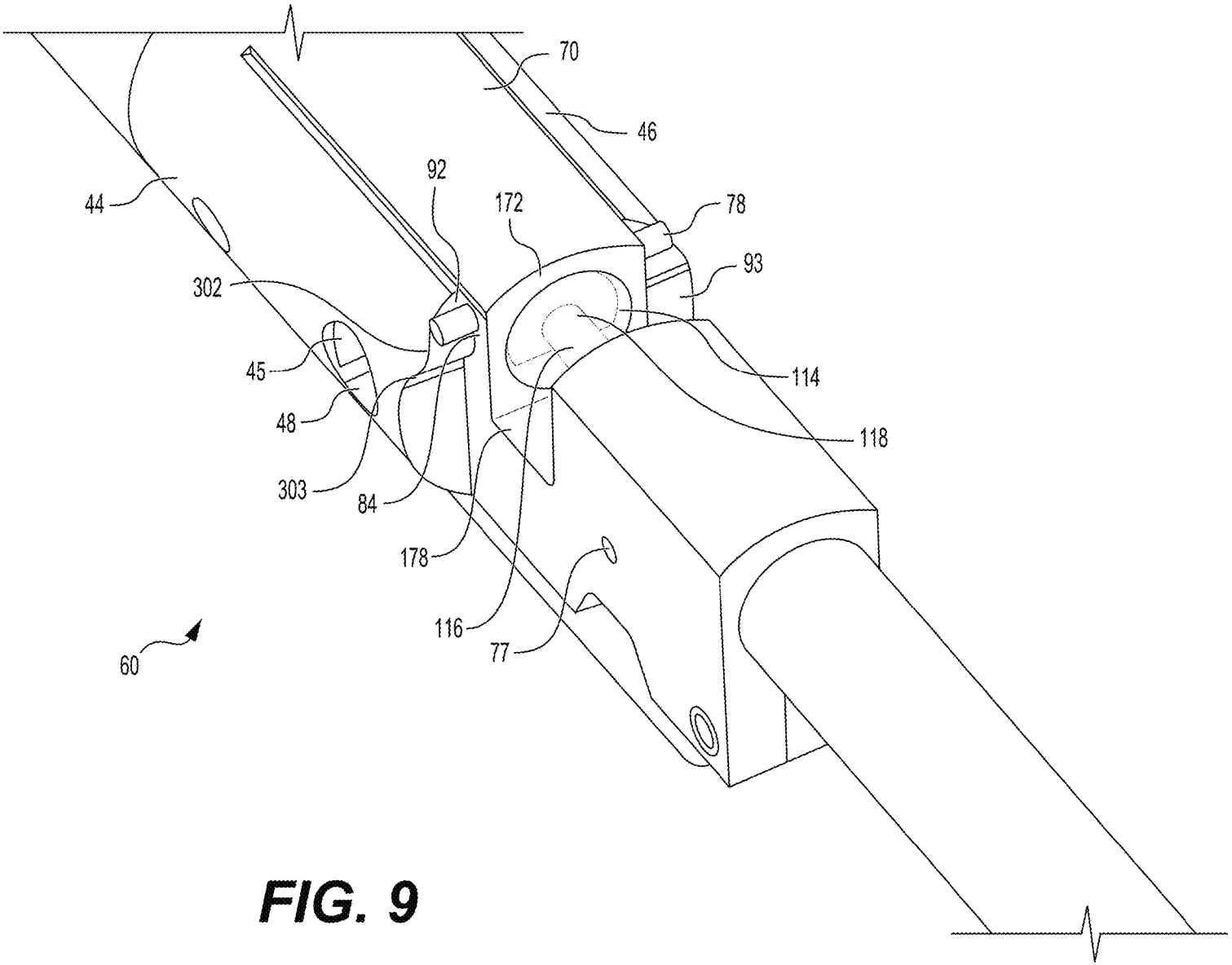
FIG. 9 is a partial top, front, right side view of the automatic loading system of FIG. 3.

As is shown in FIG. 8 compression tube 40 has a tube end 2 with a transfer tube 50 extending therethrough. As is also shown in FIG. 8, a compression piston 54 is in compression tube 40. Compression piston 54 is biased by a biasing member (not shown) which may be a gas spring, coil spring, or other resilient member or mechanism that can quickly release energy to move compression piston 54 as described herein or as otherwise known in the art during firing. As will be discussed in greater detail below, during a cocking operation, compression piston 54 is moved against the bias of the spring (not shown) to a position where compression piston 54 is secured by trigger system 20. This creates a gas filled space within compression tube 40 between compression piston 54, tube wall 52 and an opening 56 in transfer tube 50 that extends through tube end 2 and compression tube end wall 62.

Compression piston 54 has a piston seal 58 that limits the extent to which air from the gas filled space can escape between piston seal 58 and tube wall 52. Accordingly, when trigger 22 is pulled, energy from the biasing member (not shown) is released to rapidly accelerate compression piston 54 to move toward opening 56 in transfer tube 50. This has the effect of compressing gas in the gas filled state. This compressed gas is transferred through transfer tube 50 through an exit 66 of transfer tube 50. Ultimately this compressed gas applies pressure against a projectile P that is positioned for firing through a bore 28 of barrel 30. When the pressure reaches a predetermined level or range of levels, sufficient force is applied against projectile P to cause projectile P to pass through bore 28 of barrel 30 and out of airgun 10.

As noted above, breech 70 is mechanically associated with barrel 30 for movement therewith. In this non-limiting embodiment, such mechanical association is provided by way of a barrel mounting 72 which includes a barrel sleeve 74 to receive barrel 30. A pin 36 is provided in a pin mounting area 77 of breech 70 that interacts with a recess 38 in barrel 30 to hold barrel 30 in barrel sleeve 4. Other known methods, structures and mechanisms for providing a barrel 30 that is mechanically associated with breech 70 for movement therewith can be used including but not limited to forming barrel 30 and breech 70 using a common substrate.

Breech 70 further comprises the pivot mounting 80 and bolt guide 82. Pivot mounting 80 is configured to be mounted to pivot 48 so that compression tube 40 and breech 70 can rotate relative to each other. Here pivot 48 is illustrated in a non-limiting embodiment as having a cylindrical structure that can be threadedly mounted between first fork 44 and second fork 46. Similarly, pivot mounting 80 is illustrated as a cylindrical mounting within which pivot 48 can be mounted. Other structures and mechanisms can be used to enable relative movement of compression tube 40 and breech 70.

Bolt guide 82 takes the form of an area at least partially within breech 70 within which bolt 100 can be located and that is configured to cooperate with bolt 100 so that projectile contact surface 108 of bolt 100 can move a projectile P from projectile holder 132 of a projectile supply 130 held by a projectile supply positioner 140 to a position where projectile P can be fired through bore 28 of barrel 30. In the embodiment illustrated, bolt guide 82 is formed as a path within breech 70. In this embodiment, a bolt guide wall 84 is configured to interact with at least one exterior bolt surface 114 to guide bolt 100 for movement along a path that is generally parallel to an axis 94 of ore 28.

In other embodiments, bolt guide 82 can comprise arrangements of more than one wall and may use structures other than walls. For example and without limitation, frames, webs, screens, rails, nets, rails, arrangements of rollers, blades, and bearings can be used in connection with breech 70 to collectively guide bolt 100. Further, and again without limitation, a bolt guide 82 may be provided in the form of an arrangement of mechanical, magnetic, fluidic or electro-magnetic guides or bearings. In other embodiments, bolt guide 82 may without limitation take the form of one or more structures assembled to breech 70, bolt guide 82 and bolt guide 82 or components thereof can be formed from a common substrate or otherwise as a component of breech 70.

Bolt 100 is shown having a bolt body 102, a bolt seal 104, an optional bolt transfer port 106 a projectile contact surface 108 and a bolt leader 116. Bolt body 102 is shaped to cooperate with bolt guide 82 such that projectile contact surface 108 can be urged between a firing orientation where projectile contact surface 108 has urged a projectile P into a position where air pressure can be supplied to drive an initial projectile P through ore 28 and a cocking orientation where bolt 100 does not interfere with movement of projectile holders 132 in projectile supply 130 and from which bolt 100 can be moved so that a subsequent projectile P can be fired through bore 28.

FIG. 8 shows automatic loading system 60 with bolt 100 and a projectile P in a firing position. In this example, bolt 100 positions projectile P inside ore 28. However, other embodiments are possible, for example, and without limitation, projectile P can be positioned partially in a bore 28 and partially in a segment of barrel 30 or breech 70 generally aligned with bore 28. In another non-limiting examples, projectile P may be positioned at least in part within a projectile holders 132 or within a projectile supply 130.

A biasing system 120 is provided to bias bolt 100 such that movement of projectile contact surface 108 from a side of a projectile supply positioner 140 more proximate to bolt guide 82 to a side of projectile supply positioner 170 more proximate to barrel 30 is made against the bias supplied by biasing system 120. Biasing system 120 can take any known form, including but not limited to mechanical or gas springs, an arrangement of one or more magnets or electromagnets, elastically expanding materials or other structures, mechanisms or materials or systems capable of providing bias as described herein.

Biasing system 120 is illustrated as having a biasing member 121 the form of a compression spring and is illustrated as being positioned within a biasing member path 122 between a spring guide surface 112 of bolt 100, a spring guide surface 118 of breech 70, a bolt bias surface 124 and a breech bias surface 126. Other arrangements for a biasing system 120 can be used.

An optional alignment rod 128 is also illustrated positioned in biasing member path 122. Here, alignment rod 128 is positioned within a compression spring type of biasing system 120 to reduce the risk of folding of biasing system 120 within biasing member path 122. Such an alignment rod 128 can be used with other types of biasing system 120 to the extent useful to provide axial support and may not be necessary in other embodiments.

In embodiments, biasing system 120 can be arranged to interact with breech 70 and bolt 100 directly as shown or by way of intermediate structures. Additionally, in other embodiments, biasing system 120 can be arranged to interact with bolt 100 in other ways including but not limited to applying tension to bias bolt 100 away from barrel 30 or by way of using pneumatic, electromagnetic or elastic means.

Projectile Supply and Projectile Supply Holder

Projectile supply 130 stores projectiles in projectile holders 132 and when loaded is configured to position at least one projectile holder 132 having at least one projectile to a predetermined loading area 144 that is generally between and aligned with at least a portion of a path of travel of a projectile contact surface 108 of a bolt 100 as projectile contact surface 108 is advanced from a cocked position toward a firing position proximate to the bore 28.

Figure 10:
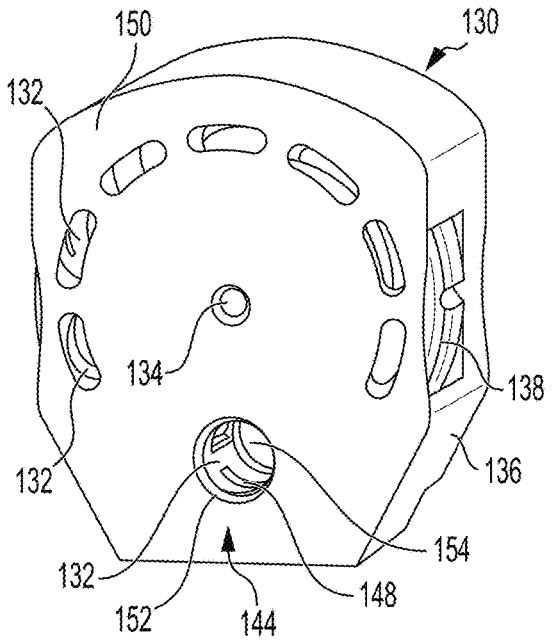
FIG. 10 is a back, right, top perspective view of one embodiment of a magazine type projectile supply useful in the airgun of FIG. 3.
Figure 11:
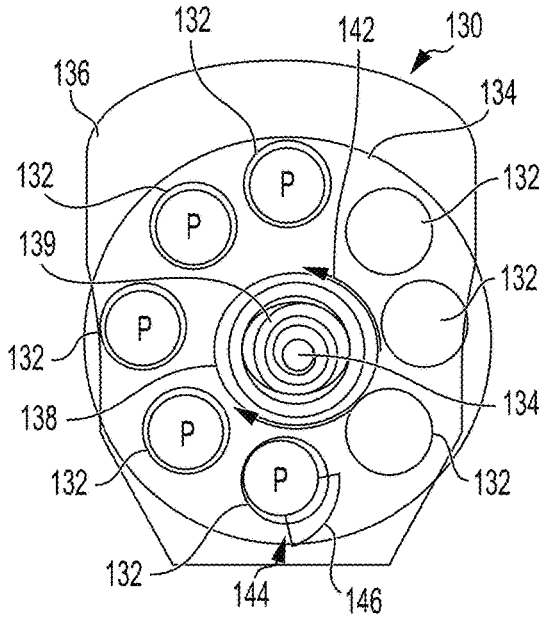
FIG. 11 is a back elevation view of the embodiment of a magazine type projectile supply of FIG. 10
Figure 12:
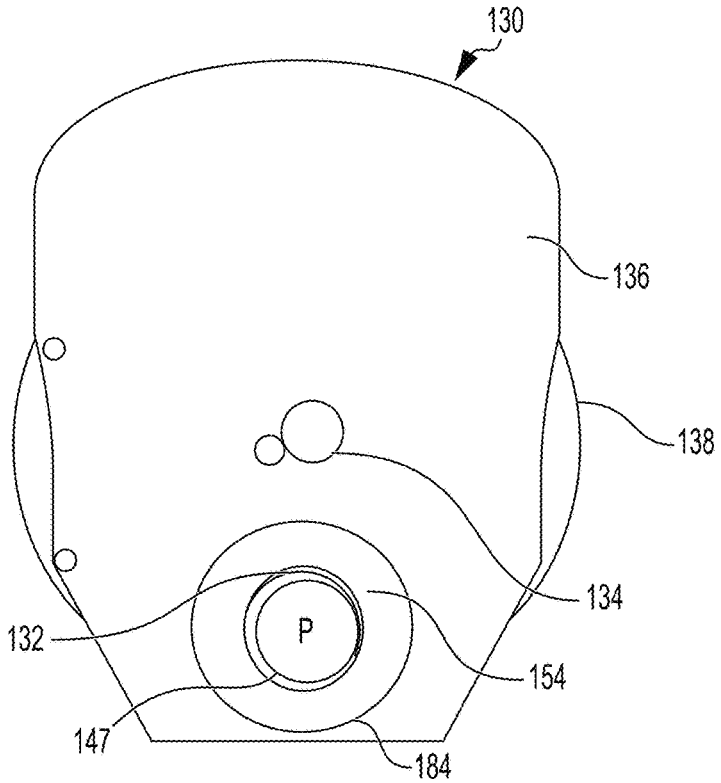
FIG. 12 is a front elevation view of an the embodiment of a magazine type projectile supply of FIG. 10.
Figure 13:
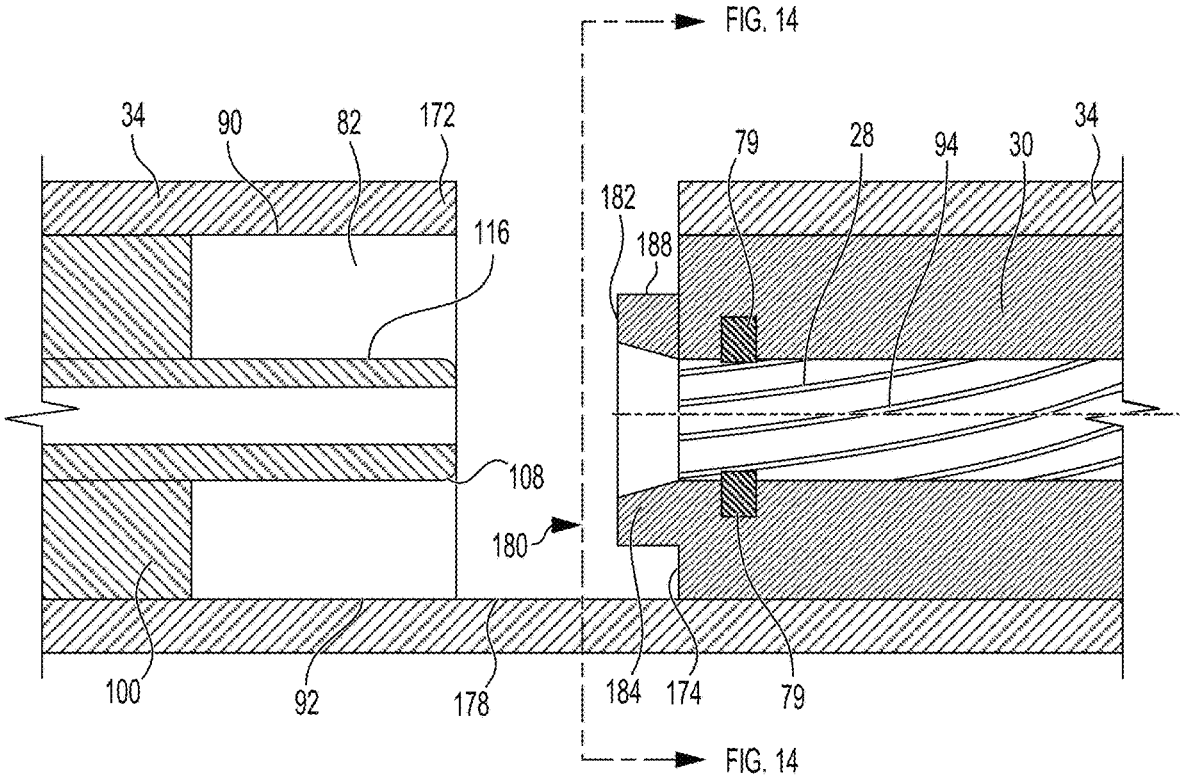
FIG. 13 is a section view of a portion of breech, bolt and barrel of the embodiment of FIG. 3, taken as is illustrated in FIG. 7

Projectile supply positioner 170 is adapted to receive a projectile supply 130 that is in the form of a magazine. FIG. 10 is a back, top, right side perspective view one example of a projectile supply 130 that can be used with projectile supply holder 160. FIG. 11 is a front view of projectile supply 130 of FIG. 10 partially loaded and with a cover removed. FIG. 12 is a back view of projectile supply 130 of FIG. 10. As can be seen in FIGS. 11-13, projectile supply 130 has a plurality of projectile holders 132. Projectile holders 132 can each be loaded with a projectile P. Projectile holders 132 are arranged to move from other portions of projectile holder 132 through a loading area 144 in a generally predetermined pattern to bring a sequence of loaded projectiles into loading area 144. Projectile supply 130 includes a cover 150 that generally prevents a projectiles P loaded in projectile holders 132 from exiting projectile holders 132 on one side of projectile holders 132 while case 136 generally prevents projectiles in projectile holders 132 from exiting on the other side of projectile holders 132.

As is shown in FIGS. 11, 12, and 13 this embodiment of projectile supply 130 has plurality of projectile holders 132 that are moved by a carousel 138 that rotates about a pivot 134. Pivot 134 is joined to carousel 138 and to case 136. A rotation spring 139 such as a clock spring or coil spring is located in projectile supply 130 and is connected to pivot 134 and to carousel 138 to store energy that urges carousel 138 to rotate in a first direction 142 through loading area 144. Such energy may be stored by rotating carousel in a second direction 156.

A stop 147 is arranged proximate loading area 144. Carousel 138 and projectile holders 132 are arranged so that carousel 138 can rotate in first direction 142 without substantial interference from stop 147 when no projectile P is in a projectile holder 132 that is in the loading area 144.

In the embodiment illustrated, projectile holders 132 provide a stop gap 148 through which stop 147 can pass to permit rotation when no projectile or other object is in the projectile holder 132 that is proximate to loading area 144. However, projectile holders 132, carousel 138 and stop 147 are also arranged so that movement of stop 147 through a stop gap 148 is blocked when a projectile P or other object is in projectile holder 132. In this way, blocking projectile P and projectile holder 132 holding the blocking projectile P are at located in loading area 144. Access to a projectile holder 132 positioned in loading area 144 is provided by cover path 152 in cover 150 and a case path 154 located in case 146. In the embodiment illustrated, cover path 152 and case path 154 are generally-positioned such that a portion of bolt 100 having projectile contact surface 108 can be moved through cover path 152 and through case path 154 as bolt 100 is moved. In other embodiments it may be possible for a projectile P to be fired from within projectile holder 132 or from a position between projectile holder 132 and case path 154. In such embodiments it may not be necessary for bolt 100 to be moved fully through case path 154.

Projectile supply 130 is separable from airgun 10 to facilitate loading of projectiles into projectile supply 130 or to enable quick reloading for example and without limitation and a projectile supply positioner 170 holds projectile supply 130 to airgun 10 generally between bolt guide 82 and ore 28 so that movement of bolt 100 and bolt leader 116 can move projectile contact surface 108 through a projectile holder 132 positioned and can move projectiles from projectile supply 130 to a position where such projectiles can be fired by through bore 28 of barrel 30.

Figure 14:
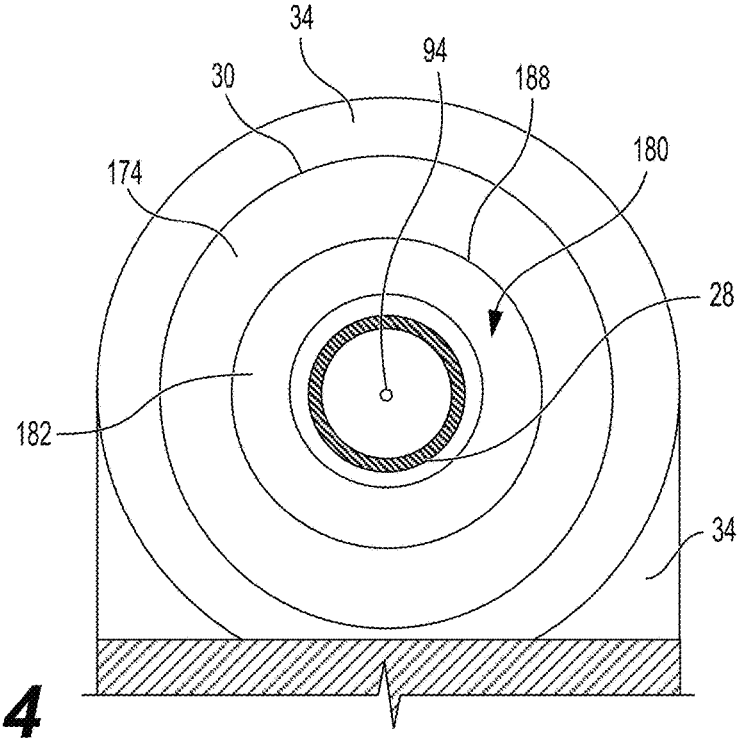
FIG. 14 is a rear view of a portion of components of a breech, barrel holder and barrel taken as indicated in FIG. 13.

FIG. 13 is a section view of a portion of breech, bolt and barrel of the embodiment of FIG. 3, taken as is illustrated in FIG. 7 but with bolt 100 shown positioned outside of projectile holders 132. FIG. 14 is a back partial cross-section view of airgun 10 taken as illustrated in FIG. 13. FIGS. 13 and 14 illustrate one embodiment of a projectile supply positioner 170 usable with projectile supply 130. In this embodiment, projectile supply positioner 170 has a bolt side surface 172 and a barrel side surface 174 separated by about a width of a projectile supply 130 to be used with airgun 10. Bolt side surface 172 and barrel side surface 174 generally determine a range of motion of magazine type projectile supply (not shown in FIGS. 13 and 14) along a length of airgun 10. In this embodiment, an alignment member 180 is located on barrel side surface 174 and provides at least one alignment feature 188 such as a surface that interacts with features of projectile supply 130 to provide a predetermined range of accuracy of the position of projectile supply 130 in relation to ore 28, bolt 100, bolt leader 116 and projectile contact surface 108. A bottom surface 178 may interact with cover 150 or case 146 of projectile supply 130 to limit rotational movement of projectile supply 130. Other mechanisms and structures can be used for this purpose.

In the embodiment illustrated, alignment member 180 comprises an alignment feature 188 in the form of a surface that extends from barrel side surface 174 to a common circular plateau 182 that is generally centered about ore 28 and a non-rifled skirt engagement surface 184 leading to bore 28. In this embodiment, projectile supply 130 has a case 146 with one or more co-designed magazine location surfaces shaped to interact with projectile supply positioner 170 to help to position loading area 144 relative to a ore 28 in axial directions relative to an axis of ore 28. Alignment member 180 can take other shapes, for example and without limitation, alignment member 180 may take to cubic, hemispherical, conical, rhomboidal, other shapes. In embodiments, alignment member 180 may take the form of a recess in barrel 30 or breech 70 while projectile holder positioning surface on case 146 may project into these recesses.

Additionally, other forms of physical interaction between magazine and rifle including electromagnetic, magnetic or fluidic interfaces. Additionally, in embodiments, projectile holder positioning surface 184 may be located on other surfaces of projectile supply holder 160 with projectile supply 130 having co-designed features to cooperate therewith as necessary.

When a projectile supply 130 is positioned in projectile supply holder 160, case 136 and cover 150 or components joined thereto act to position projectile supply 130 with loading area 144 in a path of travel of a bolt leader 116 and projectile contact surface 108 as bolt 100 is moved.

Compressed Air Management

Figure 15:
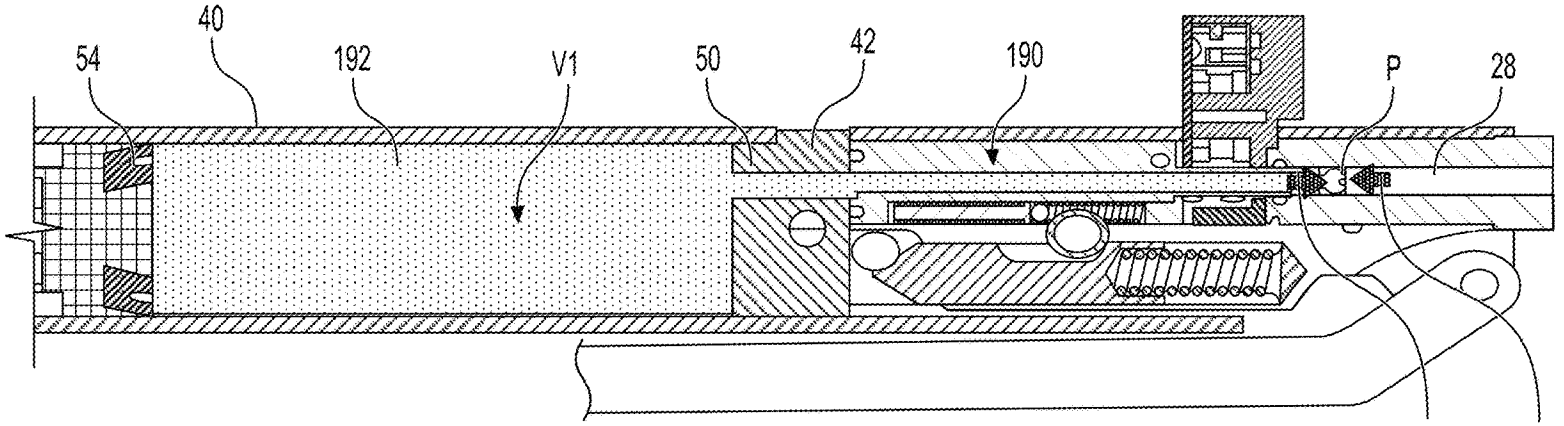
FIG. 15 is a right side cross-section view of an air management system of the airgun of FIG. 3 when ready for firing.

FIG. 15 shows a right side cross-section view of an air management system of the airgun of FIG. 3 when ready for firing. As is shown in FIG. 15, prior to firing, a gas 192 fills an initial volume V1 of a pressure system 190 created between compression tube 40, tube end 42, compression piston 54, transfer tube 50, ore 28 and projectile P. The gas 192 in initial volume V1 as an initial pressure which exerts an initial force IF on projectile P.

Figure 16:
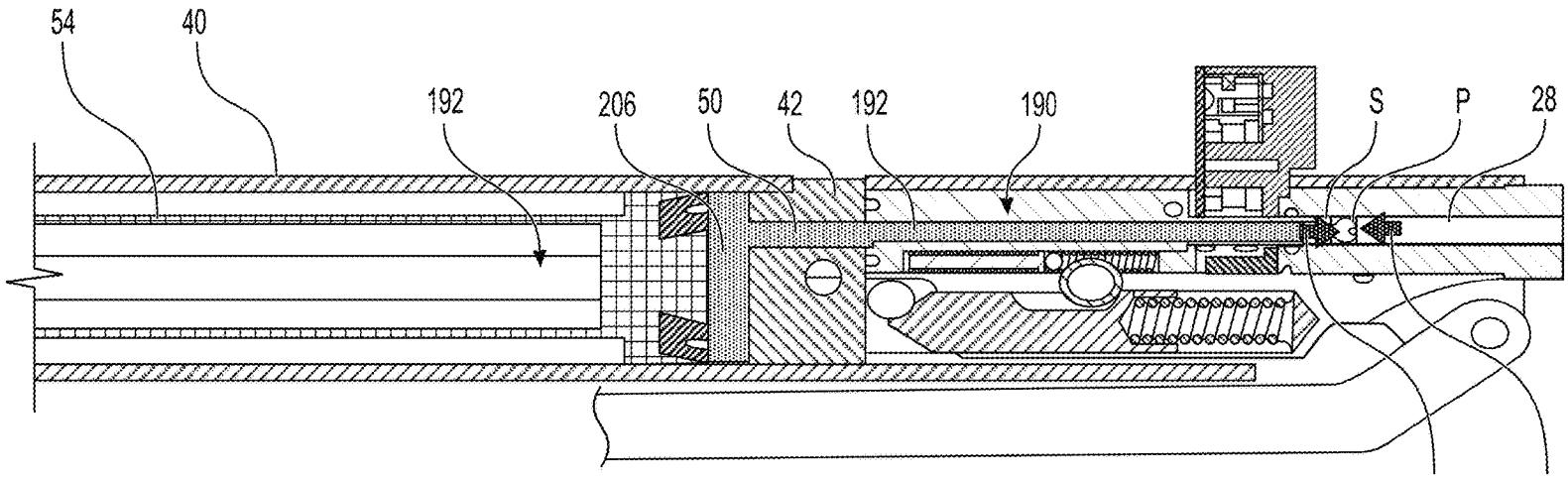
FIG. 16 is a right side cross-section view of an air management system of the airgun of FIG. 3 during firing.

FIG. 16 shows a right side cross-section view of an air management system of the airgun of FIG. 3 during firing. As is shown in FIG. 16, when airgun 10 is fired, compression piston 54 rapidly advances toward tube end 42 collapsing initial volume V1 shown in FIG. 15 to a reduced volume shown in FIG. 16. This creates a compressed gas 206 having a pressure that ultimately reaches a level sufficient to apply a firing force FF that overcomes the holding forces HF and drives projectile P through bore 28.

The amount of gas contained in pressure system 190 when airgun 10 in the cocked position is limited. Accordingly, high velocity firing and consistent accurate firing are best achieved where there is reliable conservation of the initial amount of gas within pressure system 190 during firing and losses of gas during compression are preferably limited. It will also be appreciated that consistent, high velocity, and repeatable and accurate firing of projectiles P from airgun 10 is also advantaged when volumes of other portions of pressure system 190 do not expand during firing.

Controlling energy losses due to leakage and volume increases is particularly valuable in airguns of the compression piston type as in such guns, the peak amount of pressure created by compressing gas in pressure system 190 during firing increases generally in proportion to the extent of the reduction volume of pressure system 190 between the initial volume V1 and the firing Thus, even minor movement of a projectile P within bore 28 during the final instants of compression can have a significant and negative impact on the force that is ultimately applied to projectile P.

Figure 17:
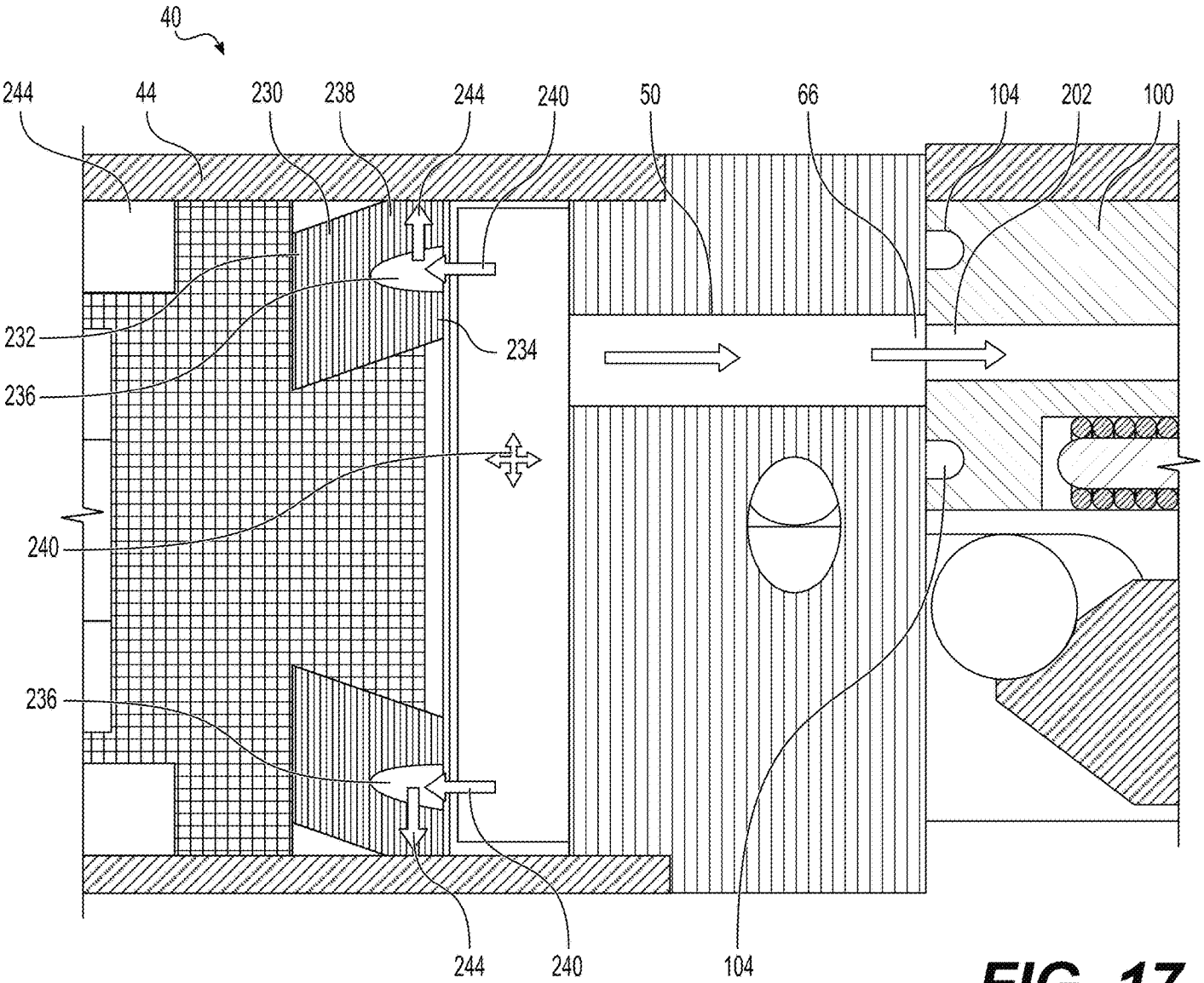
FIG. 17 is a cross section of a cut away portion of compression tube and breech showing a first embodiment of a compression seal useful in reducing gas losses between compression tube and compression piston.

It is therefore be valuable to ensure that pressure is not lost by the escape of gas between compression tube 40 and compression piston 54. FIG. 17 is a cross section of a cut away portion of compression tube 40 and breech 70 showing a first embodiment of a compression seal useful in reducing gas losses between compression tube 40 and compression piston 54. In the embodiment of FIG. 17 compression piston 54 has a piston surface 220 and a compression seal 230 with a mounting surface 232 configured for mounting substantially about a perimeter of compression piston 54 and a seal face 234 facing transfer tube 50.

A perimeter groove 236 is provided in seal face 234 substantially about a perimeter of compression seal 230. Compression seal 230 is made using a material that is sufficiently resilient to allow a sealing surface 238 of compression seal to resiliently flex outwardly.

As compression piston 54 is moved toward transfer tube 50, the volume of compression tube 40 between compression piston 54 and transfer tube 50 is reduced. This compresses the gasses in compression tube 40. The compressed air, in turn, resists compression by applying force 240 against the surfaces containing the compressed air. A portion of this force 240 enters perimeter groove 236 and applies sealing force 244 that seals sealing surface 238 against tube wall 52 so that seal face 234 can better maintain contact with the walls of compression tube 40. It will be appreciated that in this embodiment the force urging sealing surface 238 against tube wall 52 increases as the forces applied by compressed gasses against compression seal 230 increases. Accordingly enabling sealing forces 244 increase with increased pressure.

However, the dependence on pressurized air to improve sealing force can create situations early in the stroke of compression piston 54 where the sealing force is low may allow some gasses to escape between compression seal 230 and compression tube 40. This can have the effect of reducing the efficiency of airgun 10. However, if perimeter groove 236 is increased in size to increase the sealing force early in the compression process perimeter groove 236 begins to have a volume sufficient to hold enough compressed air to reduce the efficiency of airgun 10.

Figure 18:
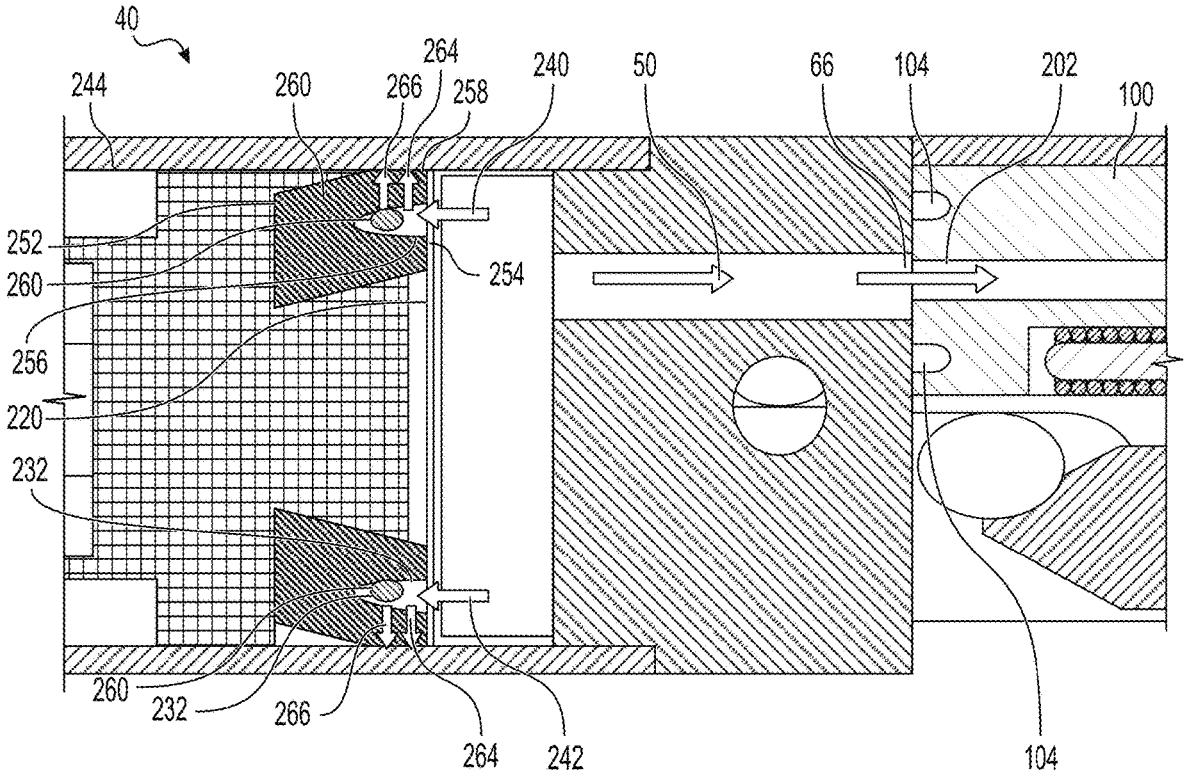
FIG. 18 is a cross section of a cut away portion of compression tube and breech showing a second embodiment of a compression seal useful in reducing gas losses between a compression tube and compression piston.
Figure 19:
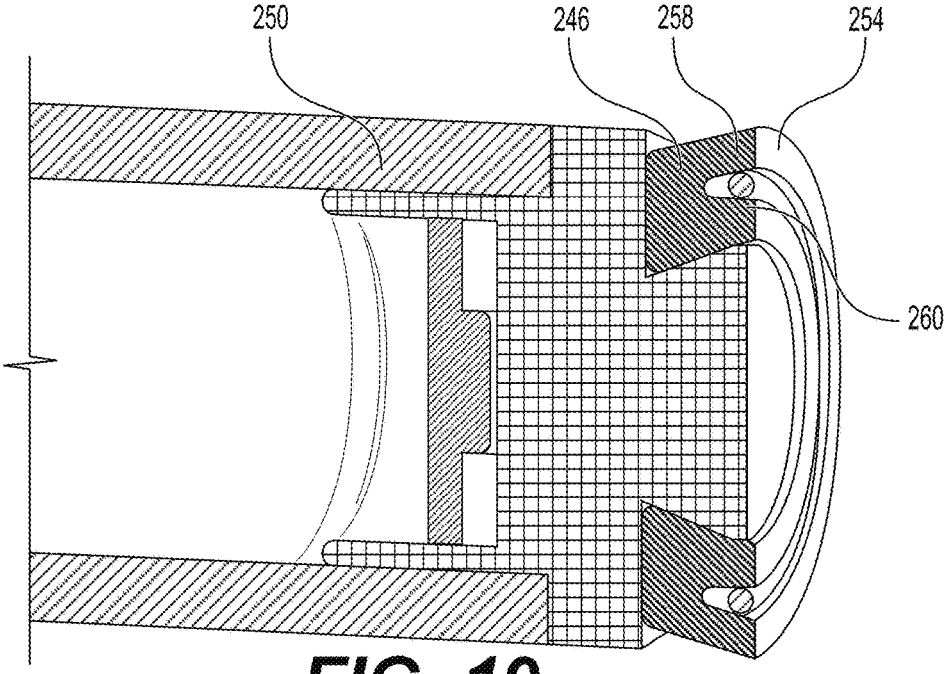
FIG. 19 is a right front side perspective view of a cross-section of a portion of a compression piston and the embodiment of compression seal useful in reducing such gas losses.

FIG. 18 is a cross section of a cut away portion of compression tube 40 and breech 70 showing a second embodiment of a compression seal useful in reducing gas losses between compression tube 40 and compression piston 54 while FIG. 19 shows a right front side perspective view of a cross-section of a portion of a compression piston 54 and a second embodiment of a compression seal useful in reducing such gas losses. Here enhanced pre-loaded seal 246 is used to provide a seal between compression piston 54 and tube wall 52. Pressure enhanced pre-loaded seal 250 has a mounting surface 252 configured for mounting substantially about a perimeter of compression piston 54 and a seal face 254 facing transfer tube 50. As is shown in the embodiment of FIGS. 18 and 19, a roove 256 is provided in seal face 254 substantially about a perimeter of compression seal 230. Pressure enhanced pre-loaded seal 250 is made using a material that is sufficiently resilient to allow a sealing surface 258 of compression seal to resiliently flex outwardly.

As is also shown in FIGS. 18 and 19, is a compression seal biasing member 260 provided that creates an outward force 266 that urges sealing surface 258 in an outward direction against sidewalls of compression tube 40. In the embodiment illustrated in FIG. 17, compression seal biasing member 260 may take the form of a resilient member that exerts an outward sealing force 246 against seal face 254 that urges seal face 254 to have a diameter that is larger when unconstrained than a diameter of compression tube 40. In one such embodiment, insertion of compression piston 54 into compression tube 40 causes elastic deformation of compression seal biasing member 260 which compression seal biasing member 260 resists to create sealing force 266. In other embodiments, other structures, articles and mechanisms can be used to urge seal face 254 against compression tube 40, including but not limited to magnetic, pneumatic or other mechanisms.

In operation, initial sealing force 266 helps to reduce the extent to which gasses can escape between compression piston 54 and compression tube 40 during early parts of the stroke of compression piston 54 when pressures in the volume of compression tube 40 between compression piston 54 and tube end 42 are lower. This helps to achieve greater efficiency during this portion of the stroke of compression piston 54. As pressures build in the volume between compression piston 54 and transfer tube 50 these pressures apply forces 242 that create forces 244 enhancing the pressures applied against seal face 254.

It will also be observed that in this embodiment, the presence of compression seal biasing member 260 in groove 256 reduces the overall volume in groove 256 limiting pressure losses that might arise due to the additional volume of groove 256 between compression piston 54 and tube end 42. Additionally, compression seal biasing member 260 can be made using different materials. intermediate pressure path provides a fluidic connection between compression tube 40 and projectile P. In embodiments, compression seal biasing member 260 can be made using materials that are different than those used to form pressure enhanced pre-loaded seal 250 to achieve desirable combination effects. In one example, pressure enhanced pre-loaded seal 250 can be made using a material that is more flexible or less resilient than compression seal biasing member 260. Additionally, in embodiments compression seal biasing member can be provided using a structure that drives pressure enhanced pre-loaded seal 250 against tube wall 52. Other configurations are possible.

Figure 20:
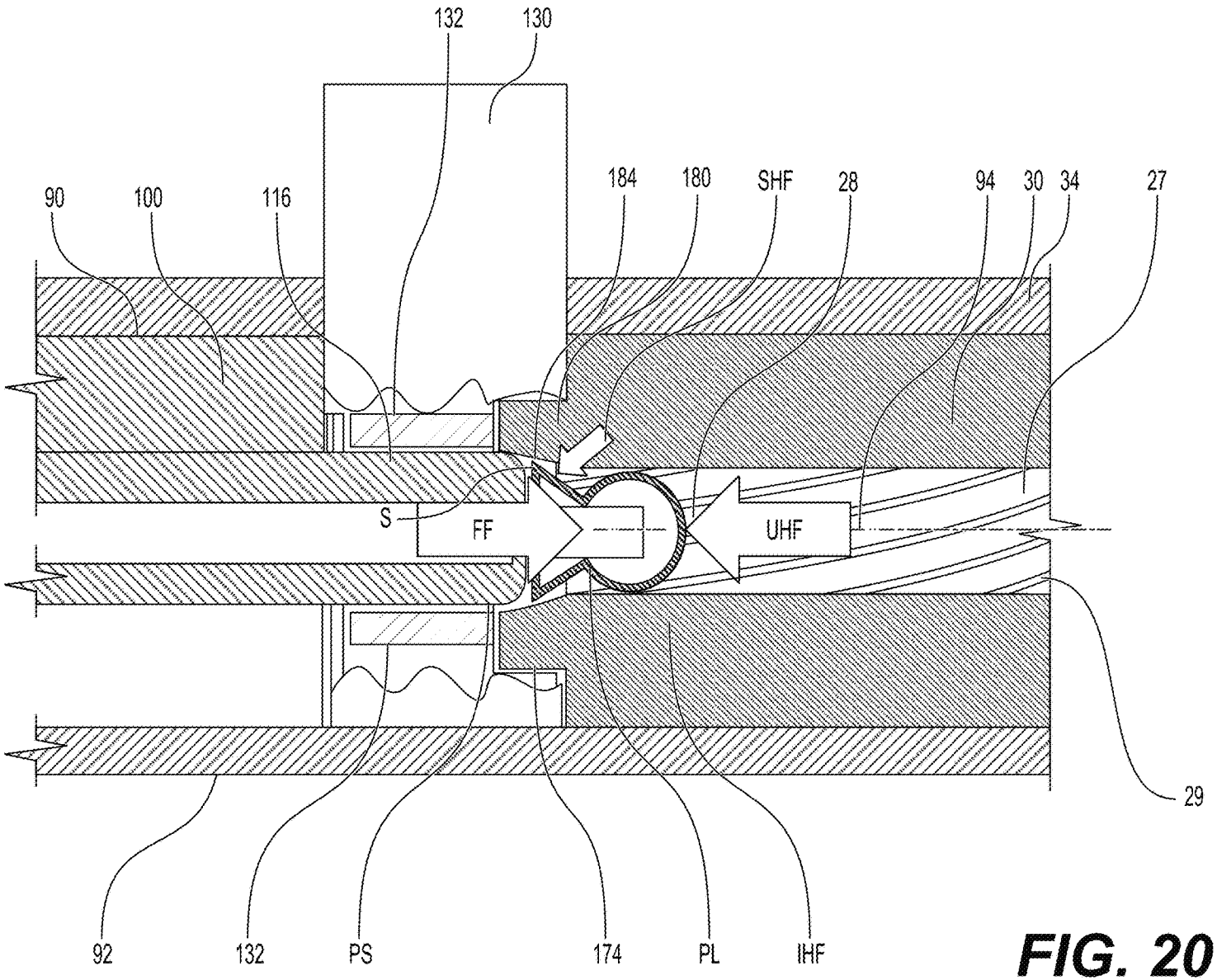
FIG. 20 is a right side cross-section view of one embodiment of an airgun having optional features intended to provide a more predictable firing force.

FIG. 20 shows one embodiment of an airgun 10 having optional features intended to provide a more predictable firing force illustrated here as FF. As noted above, during firing, the gas pressure contained in pressure system 190 is increased many fold over a short period of time by the mechanism of reducing the volume of pressure system 190. Accordingly, airgun components such as compression tube 40, compression piston 54, tube end 42, and bore 28 can be any of fabricated, assembled and made from materials that are selected to exhibit relatively little expansion when exposed to gas pressures of the magnitude expected during firing of airgun 10. Pellet P and bore 28 in contrast are designed for the purpose of allowing pellet P to be thrust down bore 28 which effectively expands the volume of pressure system 190 and lowers pressure. Thus, the force applied to a projectile P in a break barrel type airgun typically peaks just before movement of the projectile P down bore 28.

Reaching desirable peak pressures requires that projectile P not advance significantly down bore 28 until the gas pressure in pressure system 190 creates predetermined amount of firing force FF against projectile P.

Ultimate Holding forces UHF are the forces acting to hold a projectile P in place in a bore 28 while pressure builds to a firing Force FF The holding forces HF in an airgun can be caused in part by the need to co-design projectile P and bore 28 to limit the extent to which gas may leak past projectile P and escape down bore 28. In some situation, this is accomplished providing a close fit between projectile P and bore 28. In other situations this can be accomplished by providing a slightly interfering fit between projectile P and bore 28. In still further situations, projectile P may have a skirt portion S that is configured about a perimeter of projectile P and that is designed to be positioned in the bore and to be sufficiently flexible to bend outwardly under firing forces such that the skirt portion S presses outwardly against bore 28 to form a seal against bore 28. These approaches create, static and dynamic friction that also contribute to holding forces HF as projectile P and bore 28 and are typically reduced by providing lubricants in bore 28.

Holding forces HF can also include forces required to conform the shape of the projectile to the pattern of rifling grooves in the barrel. For example, in the embodiment of FIGS. 3-8, projectile P is positioned by projectile contact surface 108 in at least part of bolt leader 116 extends into portions of bore 28 and positions projectile P fully inside bore 28 when airgun 10 is prepared to fire. In this embodiment, bore 28 is shown with rifling surfaces 29 separated by interstitial bore wall portions 27. Rifling surfaces 29 are generally spiral along continuous paths within bore 28 and extend inwardly from interstitial bore wall portions 27 by an extent sufficient to engage with a projectile P attempting to traverse bore 28, so as to impart an axial spin to projectile P as projectile P is thrust down bore 28 during firing. There are various known shapes and twist rates for such rifling and a variety of different types of rifling surfaces 29 are known and useful.

Interstitial bore wall portions 27 and projectile P are sized generally to allow projectile P to be accelerated through bore 28 with minimum leakage of propellant gases. However, rifling surfaces 29 extend into the spaces between interstitial bore wall portions 27, such that projectile P must be plastically deformed to conform to the shape and configuration of rifling surfaces 29 before projectile P can travel along bore 28. Conventionally, rifling surfaces 29 are made from a material that is stronger than a material used to form portions of projectile P that engage the rifling surfaces 29 such that when enough force is applied to projectile P, projectile P will begin to yield in a plastic manner to conform to the shape of rifling surfaces 29.

It will be appreciated therefore that there are a number of different system design factors such as geometries, material choices, and design choices for bore 28 and projectile P that interact in a way that contribute to the holding forces HF. It will also be appreciated that all of these system design factors may vary within manufacturing tolerances. Still further it will be understood that temperature and other environmental conditions may also introduce variations including but not limited to variations in the geometries projectile or bore geometries such that the actual amount of holding force for a particular air gun may vary causing variations in shot velocities and accuracy.

There is a risk that in some instances such ultimate holding force UHF variations may allow a projectile P to move a short distance down bore 28 during compression of the gasses in pressure system 190 but before the pressure in pressure system 190 reaches a predetermined range pressures required to generate a predetermined range of firing forces FF. When such movement occurs, the volume of pressure system 190 is effectively increased. As noted above, even small increases variations in the volume of pressure system 190 can partially offset the pressure increases achieved by compression. This limits the pressure that can be achieved in pressure system 190 during firing of airgun 10 and can prevent a firing force from reaching a desired range. This reduces both spin rate and velocity which can negatively impact projectile trajectory. Accordingly, as shown in FIG. 20, in embodiments bolt leader 116 and projectile contact surface 108 may press projectile P at least partially into contact with rifling surfaces 29 so as to at least initiate the deformation of projectile P that is necessary to drive projectile P through bore 28.

Skirt S of projectile P is positioned at a rear portion of projectile P and is designed to flex radially outwardly within bore 28 as forces acting on projectile P increase to the firing force. This outward flexing forces skirt portion SP against bore 28 to provide a seal against bore 28 with a sealing force that increases as the air pressure against projectile P is increased. This helps to limit the amount of compressed air, if any, passing projectile P as the air pressure rises to levels sufficient deliver the firing force.

In embodiments, skirt S may be positioned in bore 28 such that during firing skirt S first deforms to engage the rifling surfaces 29 and further deforms to seal against interstitial bore wall portions 27. However, this approach can result in leakage of air and loss of pressure as flexing of the skirt S takes place. In other embodiments, skirt S may be positioned partially engaged with a rifled portion of bore 28 and partially engaged with oversized crown or taper about the tail portion of the bore 28. This allows the skirt to engage a smooth surface to stop leakage without having to first be deformed into rails. It will be appreciated that energy is required to achieve such first and second deformations and that such deformations contribute to the holding forces. To the extent that pellet and bore geometries vary and pellet materials can vary variations in holding forces may arise.

However, in embodiments such as the one shown in FIG. 20, projectile P is positioned adjacent to a non-rifled skirt engagement surface 184 shown here as having a continuous and tapering form extending from a first diameter to a diameter of bore 28. Here, bolt 100 positions projectile P such that projectile skirt S is positioned proximate to and arranged for firing through bore 28 but also positions projectile P so that projectile P is held with sufficient initial holding forces IHF to allow skirt S to react to increasing pressure during firing by expanding against a non-rifled skirt engagement surface 184 proximate to bore 28. The non-rifled skirt engagement surface 184 is configured to engage with a pressure expanded skirt S to create skirt holding forces SRF that alone or in combination with the initial holding forces IHF form an ultimate holding force UHF that is within a predetermined range that is narrower than a potential range of initial holding forces IHF.

Importantly, it will be observed that geometries conventionally used to form a bore 28 offer few degrees of freedom of design of a projectile given the requirements of imparting a ballistic spin onto the projectile P and given the requirement that air losses be reduced. However, there is a greater degree of freedom in designing interactions between the skirt portion and the non-rifled skirt engagement surface 184 that can be used to more precisely define a skirt holding force SRF to achieve a desirable ultimate holding force. Additionally, it will be noted that it is possible to define a pattern of skirt holding forces that a projectile will experience as projectile P ultimately begins to move.

Accordingly, in embodiments, airgun 10 can be designed with reduced reliance on the interaction of projectile P and rifling surfaces 29 to provide the ultimate holding force UHF. This reduced reliance can take the form of enabling greater firing forces to be built up before allowing projectile P to move or in reducing the variability.

As is also shown in FIG. 20 in embodiments the skirt engagement surface may have a continuous shape that is different from a continuous shape of an initial shape of skirt S in order to create the desired skirt holding force SHE. In other embodiments, skirt engagement surface may have configurations of steps, variations in slope or other variations that are designed to hold projectile P or to control the SHE. In embodiments, projectile contact surface 108 may be configured to press or shape skirt S into a configuration for engagement with non-rifled skirt engagement surface 184 to limit the amount of air escaping between skirt S and non-rifled skirt engagement surface 184 before firing and to help define the skirt holding force SRF and thereby the ultimate holding force UHF. In further embodiments, bolt 100 may be configured to drive and hold portions of skirt S between projectile contact surface 108 and non-rifled skirt engagement surface 184 and to help define the skirt holding force SRF and thereby the ultimate holding force UHF. In still other embodiments, skirt holding force SRF may be provided by a frangible portion of skirt S such that a required firing force is determined based upon an amount of force required to tear or otherwise separate the frangible portion from the remaining portion of skirt S.

As is also shown, in this embodiment, a barrel seal 110 can be provided to block or restrict airflow between bolt leader 116 and bore 28 at one end of bore 28 while projectile P serves to block or restrict airflow through the other end of bore 28. During firing compression piston 54 reduces the volume of this system thereby increasing the pressure in this system so long as projectile P remains relatively stationary.

Loading System

Figure 21:
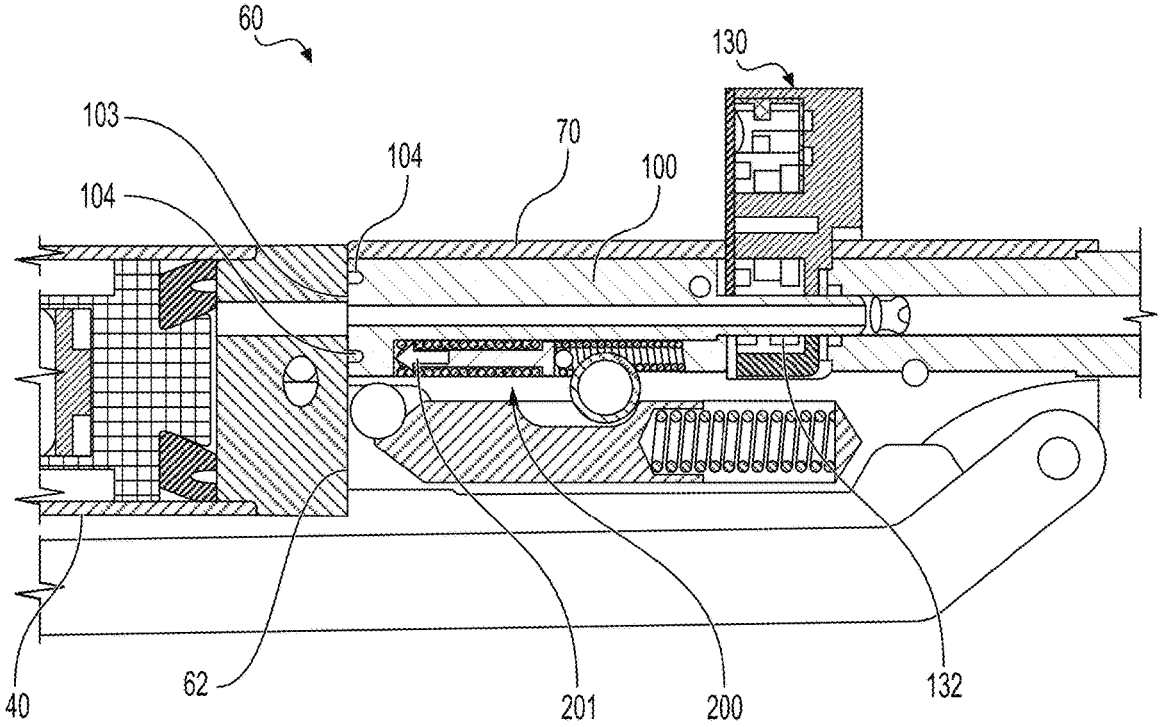
FIG. 21 is a right side cross-section view of automatic loading system immediately after firing of airgun.
Figure 22:
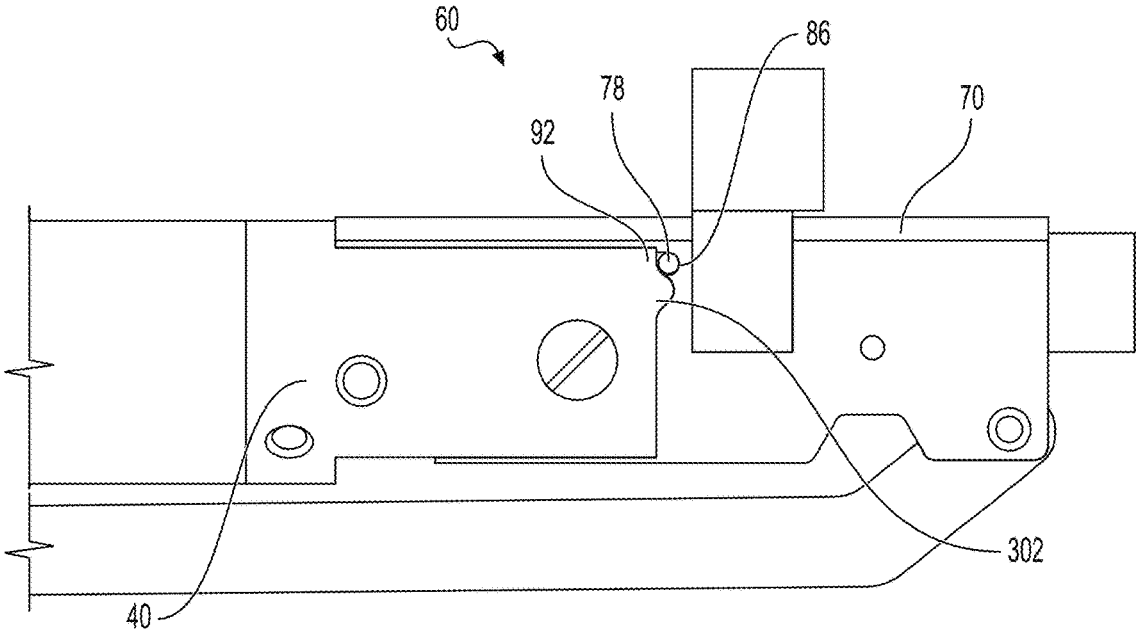
FIG. 22 is a right side view of automatic loading system in the state illustrated in FIG. 21.

FIG. 21 is a cross-section of automatic loading system 60 immediately after firing of airgun 10 while FIG. 22 is a right elevation view of automatic loading system 60 in the state illustrated in FIG. 21. In this state, bore 28 is empty, projectile supply 130 remains positioned in projectile supply positioner 170 and bolt leader 116 extends through a projectile holder 132 of carousel 138 thereby blocking projectile holder 132 from rotating so that a new projectile (not shown) can be positioned in loading area 144. Similarly, in this position, bolt biasing system 200 urges bolt 100 away from bore 28 and from projectile holder 132. In embodiments, bolt biasing system 200 can urge bolt seal 104 against compression tube end wall 62 to determine the location of bolt 100 in the firing position in such embodiments, the extent to which bolt 100 can be moved by bolt biasing system 200 relative to bore 28 can be defined the extent to which biasing force 201 applied by bolt biasing system 200 can compress bolt seal 104 against compression tube end wall 62. In still other embodiments, interactions between compression tube end wall 62 and bolt tube facing surface 103 can define the extent of to which to which bolt 100 will positioned relative to bore 28 by bolt biasing system 200 when in the firing position.

However, in the embodiment illustrated in FIGS. 20 and 21, the position of bolt 100 relative to bore 28 when in the firing position is determined by the position at which bolt biasing system 200 drives bolt positioner 78 against cam surface 92. This reduces the extent of separation between bolt leader 116 and bolt positioner 78 in the firing position and this reduction can have the effect of dampening the impact of thermal or other variables that might influence projectile positioning by bolt 100. Additionally, in embodiments, adjustment of this position may be possible by enabling bolt positioner 78 to be replaced with differently sized bolt positioners or by way of bolt positioner 78 having different portions of a circumference thereof having different radii from the center of rotation such that by rotating different portions of the circumference proximate to cam surface 92 a user can adjust the extent to which bolt 100, bolt leader 116 and projectile contact surface 108 can move relative to bore 28 when moved into and held in the firing position.

Figure 23:
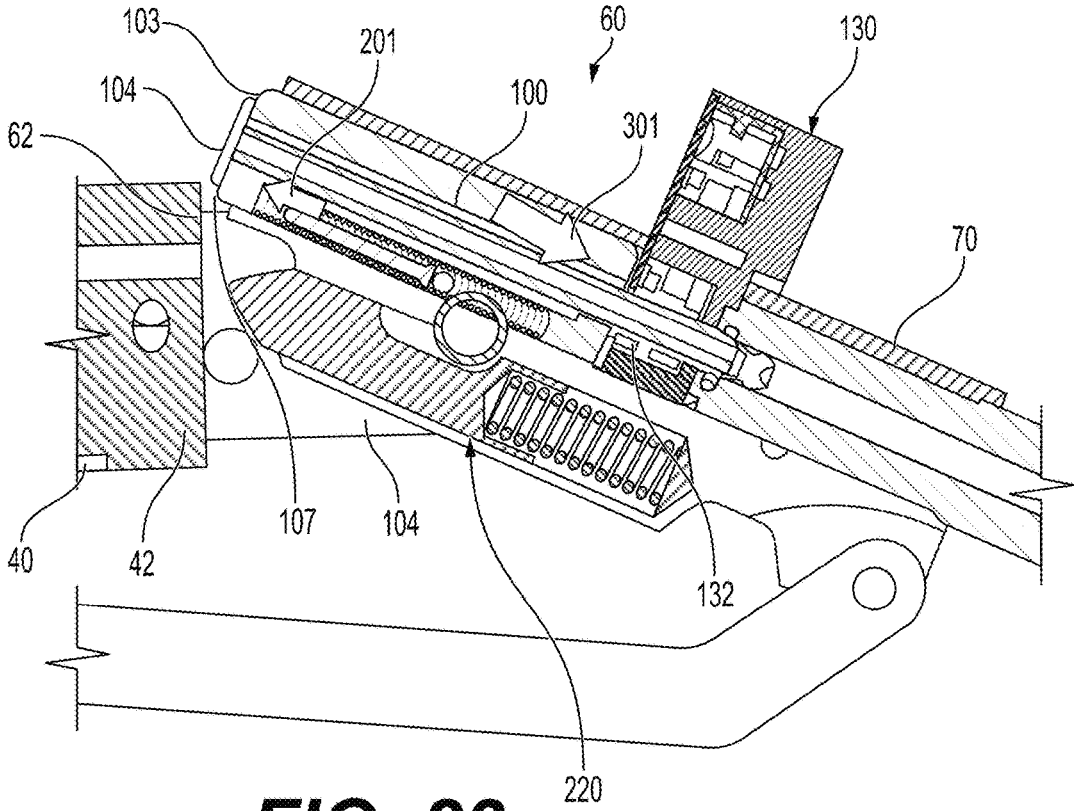
FIG. 23 is a right side cross-section view of the automatic loading system of FIG. 21 at an early stage of rotating a breech relative to a compression tube in a first direction.

The process of cocking and reloading airgun 10 begins as a user rotates breech 70 in a first direction 300 relative to compression tube 40. However, as is shown in FIGS. 22 and 23, rotating the breech 70 in first direction 300 relative to compression tube 40, drives bolt positioner 78 against a first cam lobe surface 302. Bolt positioner 78 and first cam lobe surface 302 are configured such that as bolt positioner 78 is driven against first cam lobe surface 302, cocking force 301 is produced urging bolt positioner 78 and bolt 100 away from compression tube end wall 62. Cocking force 301 first has the effect of offsetting the biasing force 201 to release any clamping forces between bolt seal 104 and tube end 42, and then overcoming biasing force 201 to allow separation of bolt seal 104 from contact with tube end 42 as breech 70 begins rotating along first direction 300. The reduction in clamping force and the ultimate separation of bolt seal 104 and tube end 42 during these stages of cocking helps protects bolt seal 104 from damage that might arise in the event that bolt seal 104 maintained a clamping force against tube end 42. This helps to reduce maintenance requirements and prevent loss of air between tube end 42 and bolt 100 during firing.

Additionally, this allows a separation between a lower edge 107 of bolt tube facing surface 103 and compression tube end wall 62 during the relative rotation of compression tube 40 and breech 70 so that bolt 100 and compression tube end wall 62 have reduced risk of frictional contact and any unintended modifications that may have arisen as a product of such contact. Additionally, this approach reduces the risk that bolt 100 such contact will cause bolt 100 to be moved in a manner that may cause unexpected consequences at bolt leader 116, projectile contact surface 108 or elsewhere along bolt 100.

Figure 24:
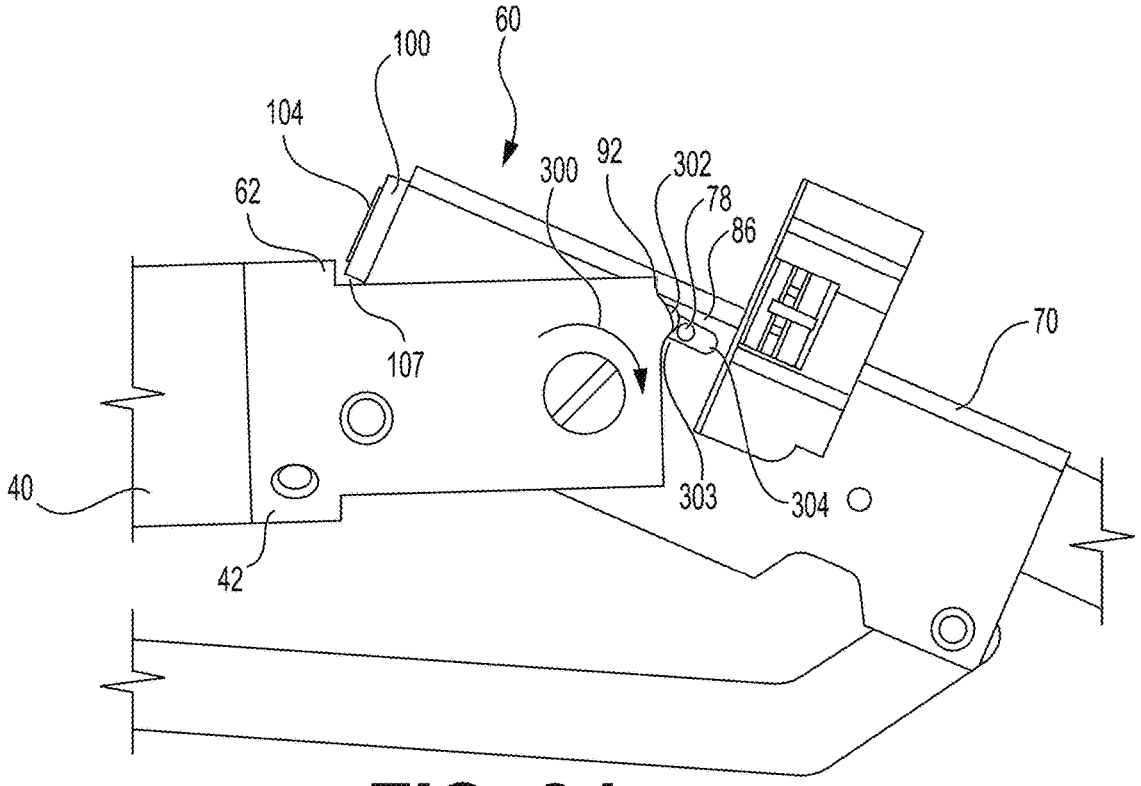
FIG. 24 is a right side view of automatic loading system of FIG. 21 in the state illustrated in FIG. 23.

As is further shown in FIGS. 21 and 22, after compression tube 40 and breech 70 are further rotated, control over the position of bolt positioner 78 passes from first cam lobe surface 302 to second cam surface 303 which controls the manner in which bolt 100 can again be urged by the urging force of bolt biasing system 200 away from bore 28. This helps to ensure that a separation between FIG. 23 is a cross-section of automatic loading system 60 of FIG. 21 at an early stage of rotating the breech 70 relative to compression tube 40 and FIG. 24 is a right side view of automatic loading system 60 of FIG. 21 in n the state illustrated in FIG. 23. In this state, bore 28 is empty and projectile supply 130 is positioned in projectile supply positioner 170. As is shown in FIG. 23, in this position bolt leader 116 continues to extend through one of the projectile holders 132 of carousel 138 thereby blocking projectile holder 132 from rotating so that a new projectile (not shown) can be positioned in loading area 144. Similarly, in this position, bolt biasing system 200 urges bolt 100 to bring bolt positioner 78 against first cam lobe surface 302 of cam surface 92 continuing the protection of bolt seal 104. In this embodiment, bolt positioner 78 and first cam lobe surface 302 are also optionally configured so that bolt tube facing surface 103 maintains a separation from tube end 42 until a point in rotation of breech 70 where allowing tube facing surface 203 to move further away from bore 28 will risk bringing tube facing surface 203 into contact with tube end 42.

Figure 25:
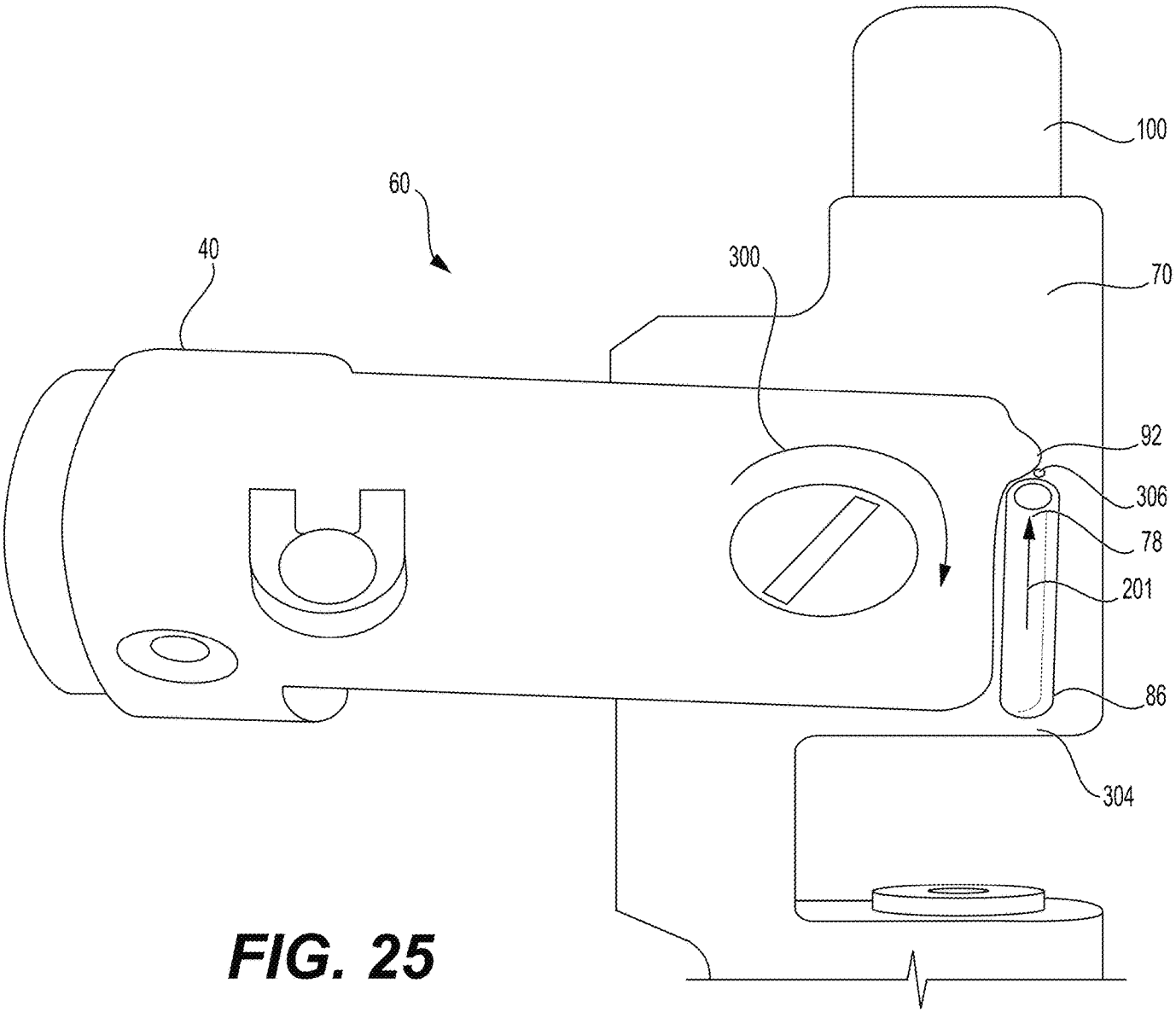
FIG. 25 is a right side view of automatic loading system at a further point of relative rotation of compression tube and breech in a first direction.

FIG. 25 is a right side view of automatic loading system 60 at a further point of relative rotation of compression tube 40 and breech 70 in first direction 300. As can be seen in FIG. 25, at this point such relative rotation has moved am surface 92 along a path that allows biasing force 201 to move bolt 100 along bolt positioner track 86 from a position generally proximate bore end 304 of bolt positioner track 86 to a position proximate tube end 306 of bolt positioner track 86.

In this embodiment, bolt positioner 78 and tube end 306 are arranged so that when bolt positioner 78 is in this position bolt leader 116 is withdrawn enough to allow rotation of carousel 138. Bolt positioner 78 is then held against tube end 306 by biasing force 201 until forces area applied against bolt positioner 78 to overcome biasing force 201.

Figure 26:
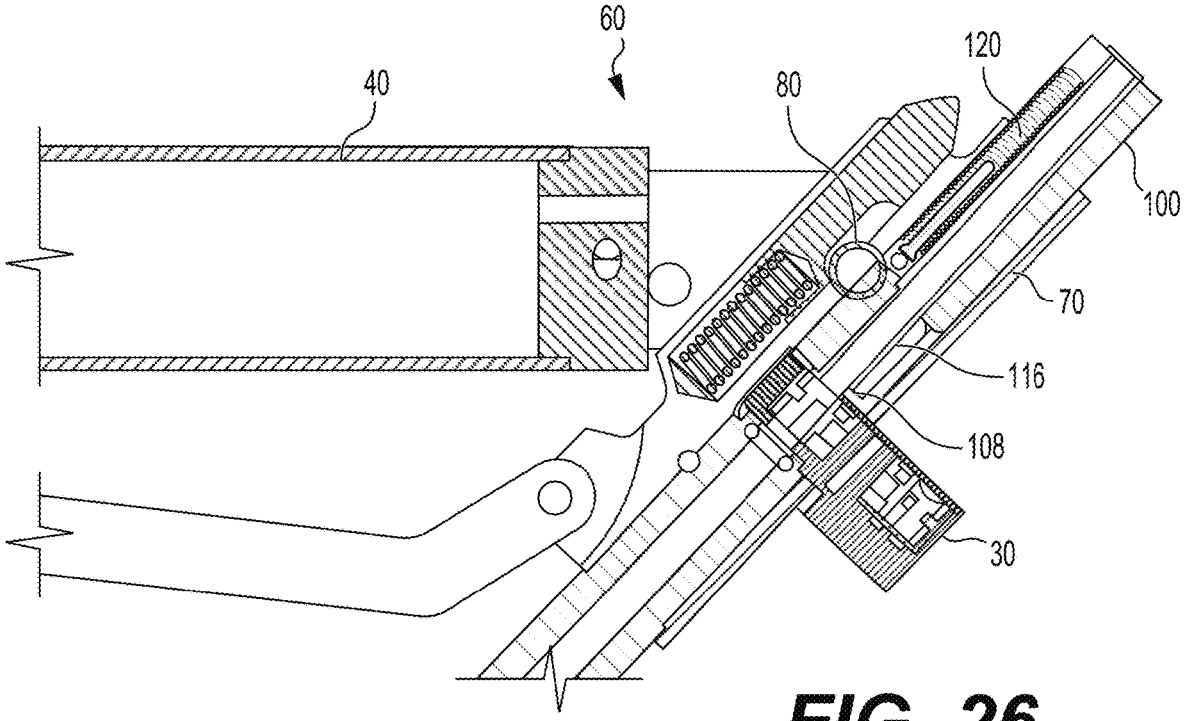
FIG. 26 is a right side cross-section of the automatic loading system of the embodiment FIG. 21 in a cocked position.
Figure 27:
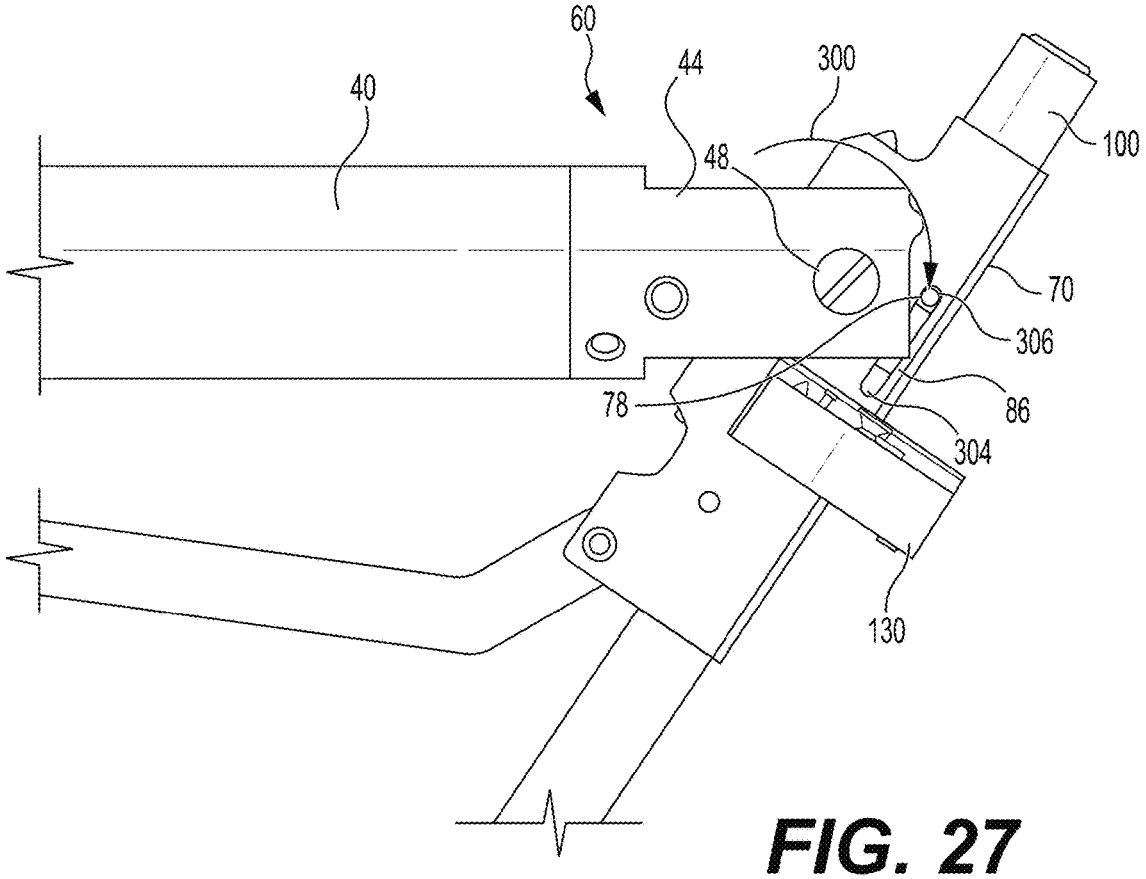
FIG. 27 is a right side view of the automatic loading system of FIG. 21 in the state illustrated in FIG. 26.

FIG. 26 shows a cross-section of the automatic loading system 60 of the embodiment of airgun 10 of FIG. 3 in a full cocking rotation position FIG. 27 shows a right side view of the automatic loading system 60. As is shown in FIGS. 26 and 27, in this position, compression tube 40 and breech 70 are rotated relative to each other about pivot 48. As can be seen in FIGS. 26 and 27, in the full cocking position, biasing system 120 continues to urge bolt 100 away from bore 28 and bolt 100 is now positioned to load.

As is shown in FIG. 26, bolt positioner 78 and bolt guide wall 84 are configured so that as bolt 100 is urged toward tube end 06, bolt leader 116 is withdrawn from bore 28 and from projectile holder 132. This allows carousel 138 of projectile supply 130 to rotate to bring a next one of the projectile holders 132 having a projectile P into a loading area 144 as described above.

Figure 28:
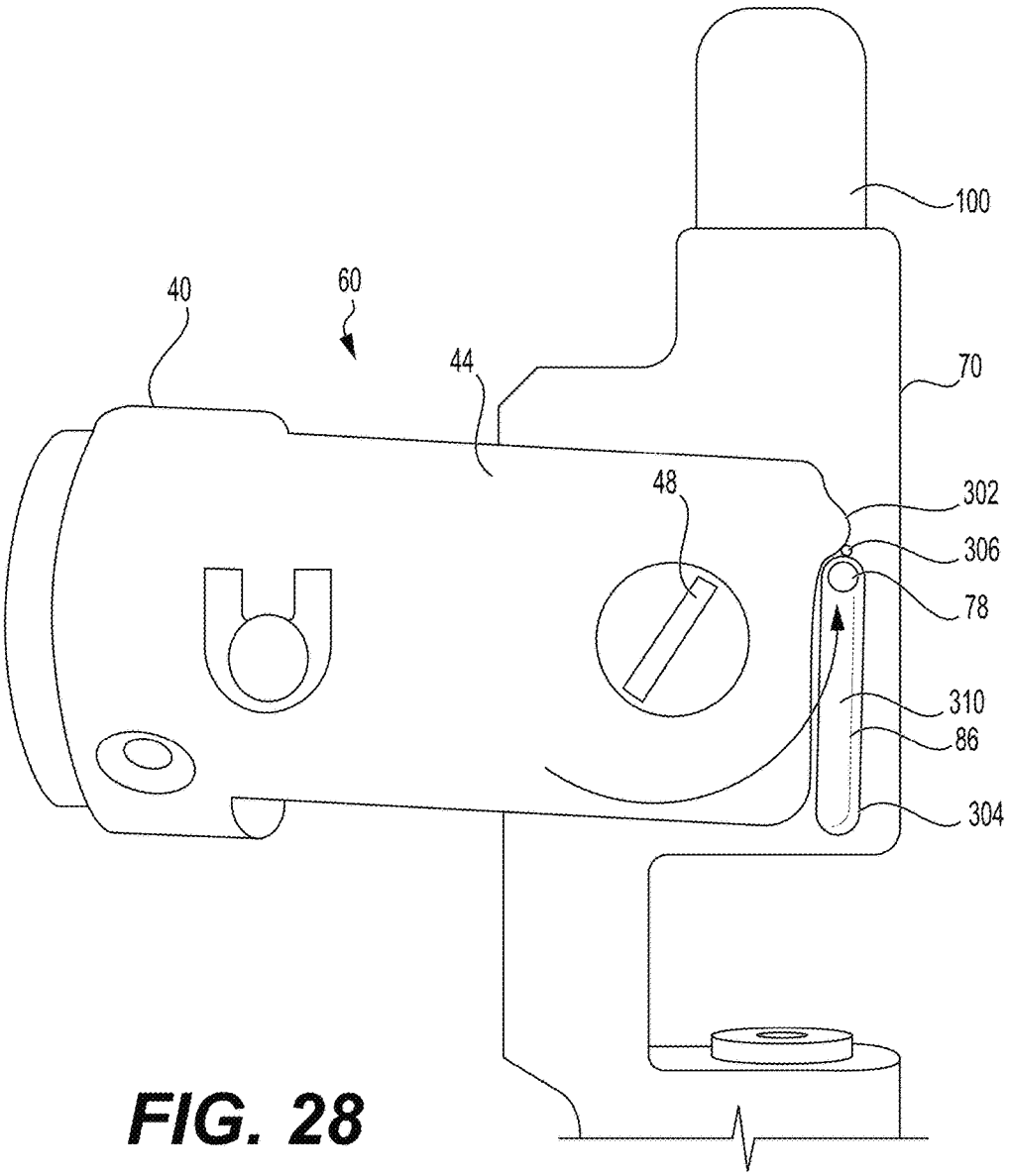
FIG. 28 is a right side view of the automatic loading system of FIG. 21 as rotation in a second direction causes a cam lobe to come into contact with a bolt positioner.

After reaching the fully cocked position, the compression tube 40 and breech 70 can be returned to the firing position by relative rotation of compression tube 40 and breech 70 about pivot 48 in a second direction 310 opposite to that of first direction 300. Rotation in second direction 310 brings second cam surface 303 and bolt positioner 78 into contact again as is shown in FIG. 28 which is a right side view of the automatic loading system of FIG. 21 at this moment.

Figure 29:
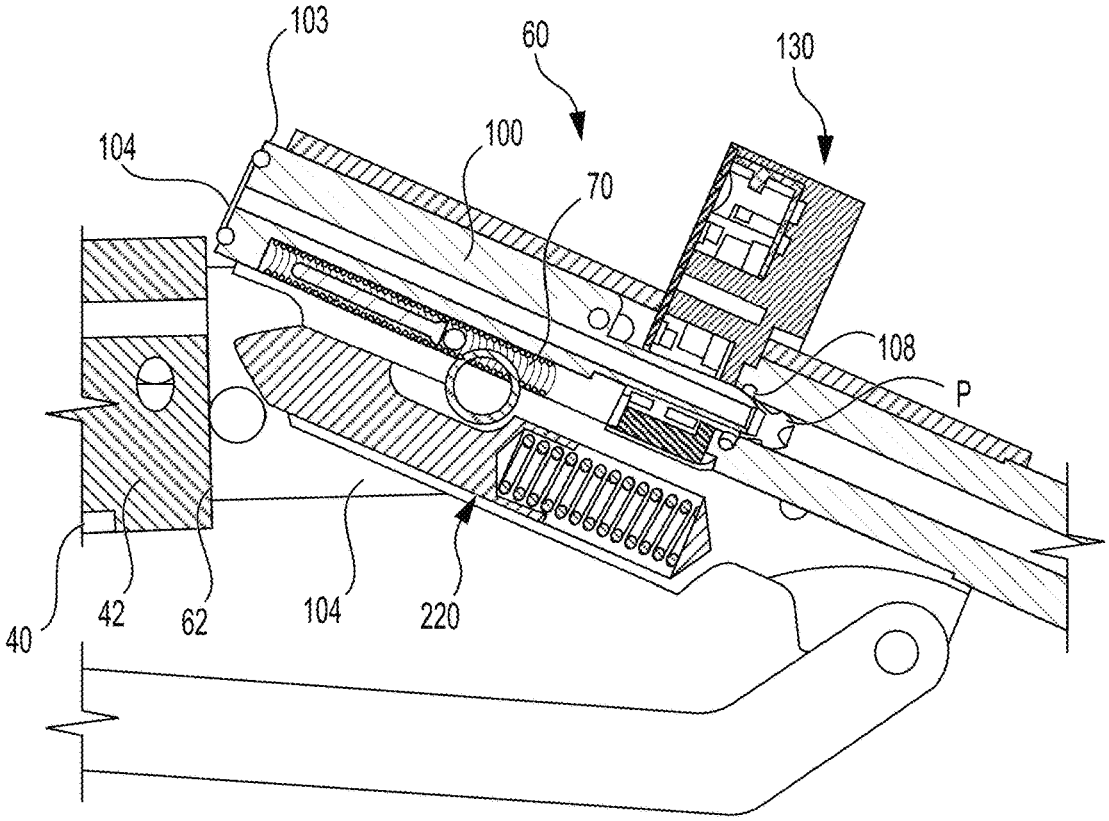
FIG. 29 is a right side cross-section of the automatic loading system of the embodiment of FIG. 21 at a further point of rotation in the second direction.
Figure 30:
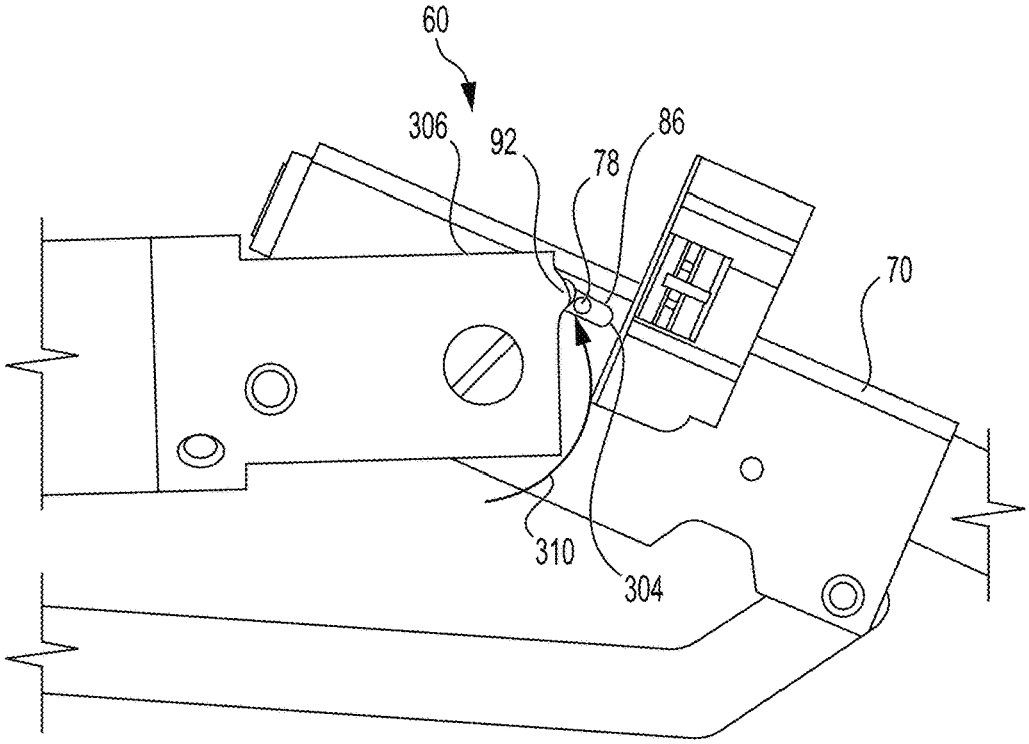
FIG. 30 is a right side view of the automatic loading system of FIG. 21 in the state illustrated in FIG. 29.

FIG. 29 Further relative rotation in second direction 310 causes second cam surface 303 to drive bolt positioner 78 from a position proximate tube end 306 of bolt positioner track 86 toward bore end 304 of bolt positioner track 86. This causes bolt 100 to begin to advance toward bore 28 and in turn causes bolt leader 116 to advance projectile contact surface 108 into projectile supply 130 and into contact with a projectile P in projectile supply 130 to begin urging projectile P toward bore 28 as described above.

Second cam surface 303 is also configured engage with bolt positioner 78 to define a distance between bolt 100 and tube end 42 to protect bolt seal 104 on bolt tube facing surface 103 from damage due to friction and exposure to shear forces as compression tube 40 and breech 70 are rotated into the firing position. The engagement can act as described above to reduce the risk of contact between lower edge 107 of bolt tube facing surface 103 and compression tube end wall 62.

Further relative rotation of compression tube 40 and breech 70 in second direction 310 moves bolt positioner 78 into a position in contact with first cam lobe surface 302 which controls the rotational rate at which bolt 100 is permitted to move toward the position that bolt 100 will occupy during firing. This control can help to reduce the risk of contact between lower edge 107 of bolt tube facing surface 103 and compression tube end wall 62. Further, in embodiments this control can also be used to substantially determine the position at which projectile contact surface 108 will position projectile P relative to bore 28 for firing.

It will be appreciated, that automatic loading system 60 provides a mechanism that can be fully within the general profile of airgun 10 when airgun 10 is in the firing position. Such a mechanism is therefore protected from exposure to elements and other environmental contaminants, optionally makes use of components and surfaces already provided in the airgun 10 such as surfaces of first fork 44 and second fork 46 requires a much smaller number of extra components, and is operates substantially in with the compression tube and bore so as to minimize or otherwise substantially reduce the extent to which optical aiming solutions such as iron sights, red dot sights and scopes must be positioned apart from bore axis 94 which can reduce parallax based aiming challenges and lower snag risks.

Figure 31:
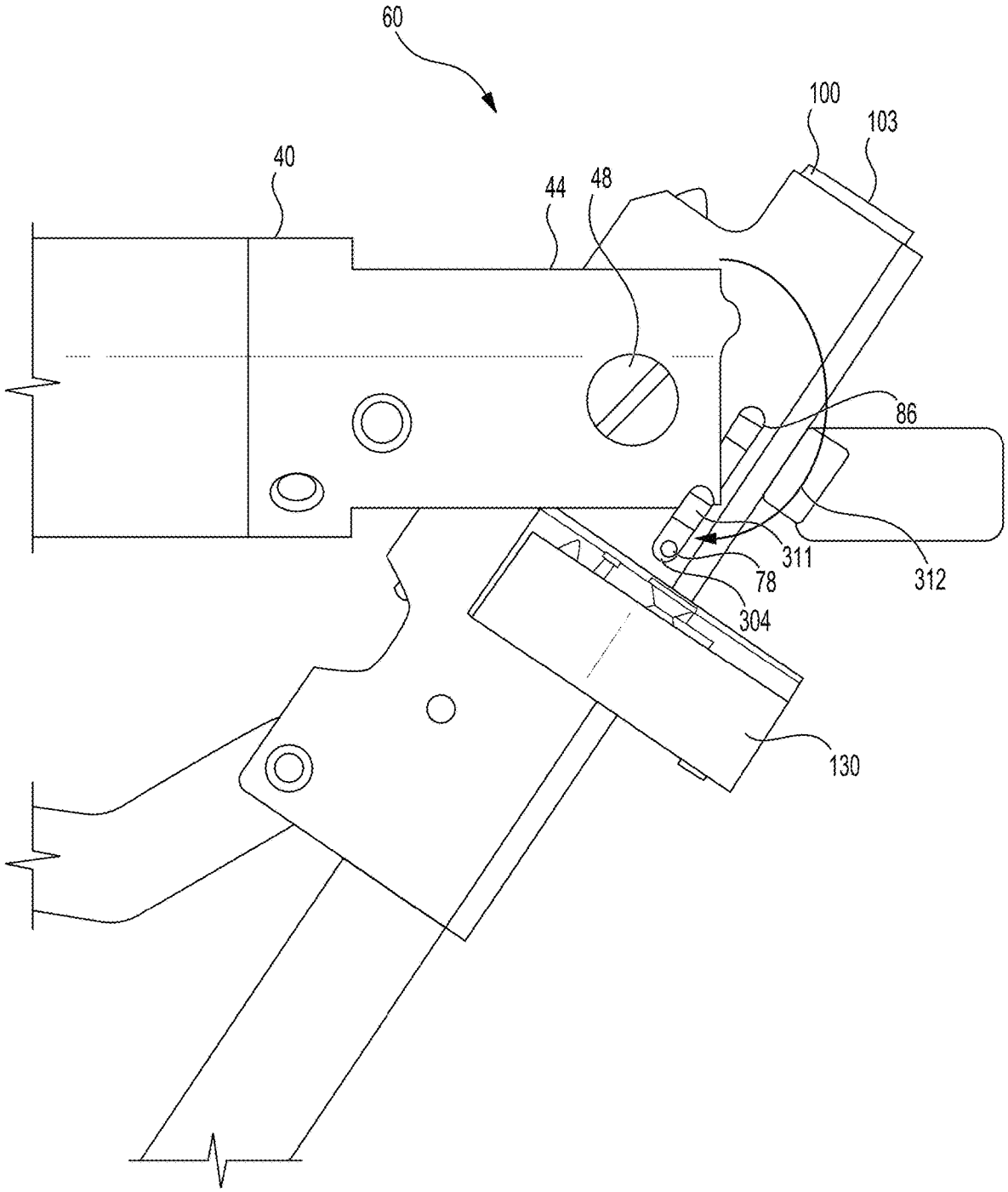
FIG. 31 is a right side view of another embodiment of and automatic loading system with an optional latch at a first point in rotation.
Figure 32:
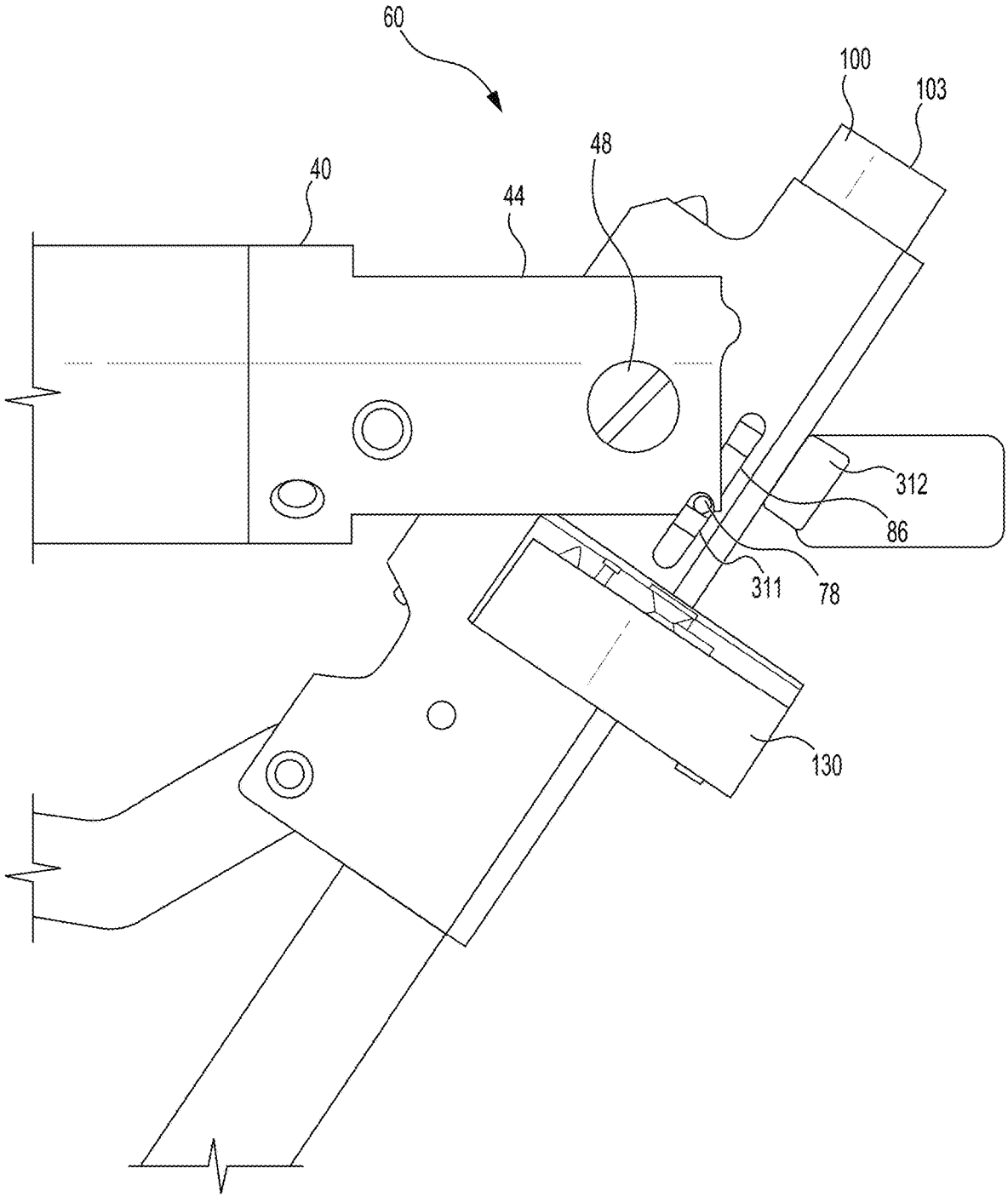
FIG. 32 is a right side view of the embodiment of FIG. 31 with a bolt positioner engaged with the latch.

FIGS. 31 and 32 show right side views of another embodiment of automatic loading system 60 having a cam surface 311 provided on first fork 44 and/or second fork 46 to allow a user to latch the automatic loading system 60 in a cocked position. This may be used, for example to facilitate service or cleaning of airgun 10, to hold airgun in the full cocking position for storage in a folded configuration or for other purposes. As is shown, a user manually depresses bolt tube facing surface 103 of bolt 100 to position bolt positioner 78 at a position proximate to the bore end 304 of bolt positioner track 86 where cam surface 92 will not interfere with further rotation of bolt positioner 78 during cocking. As shown, with the bolt positioner 78 so positioned, the user can rotate the breech to a position where bolt positioner 78 will be advanced into cam surface 311 within bolt guide 82 to a position more proximate to an and 304 of bolt guide 85.

Figure 33:
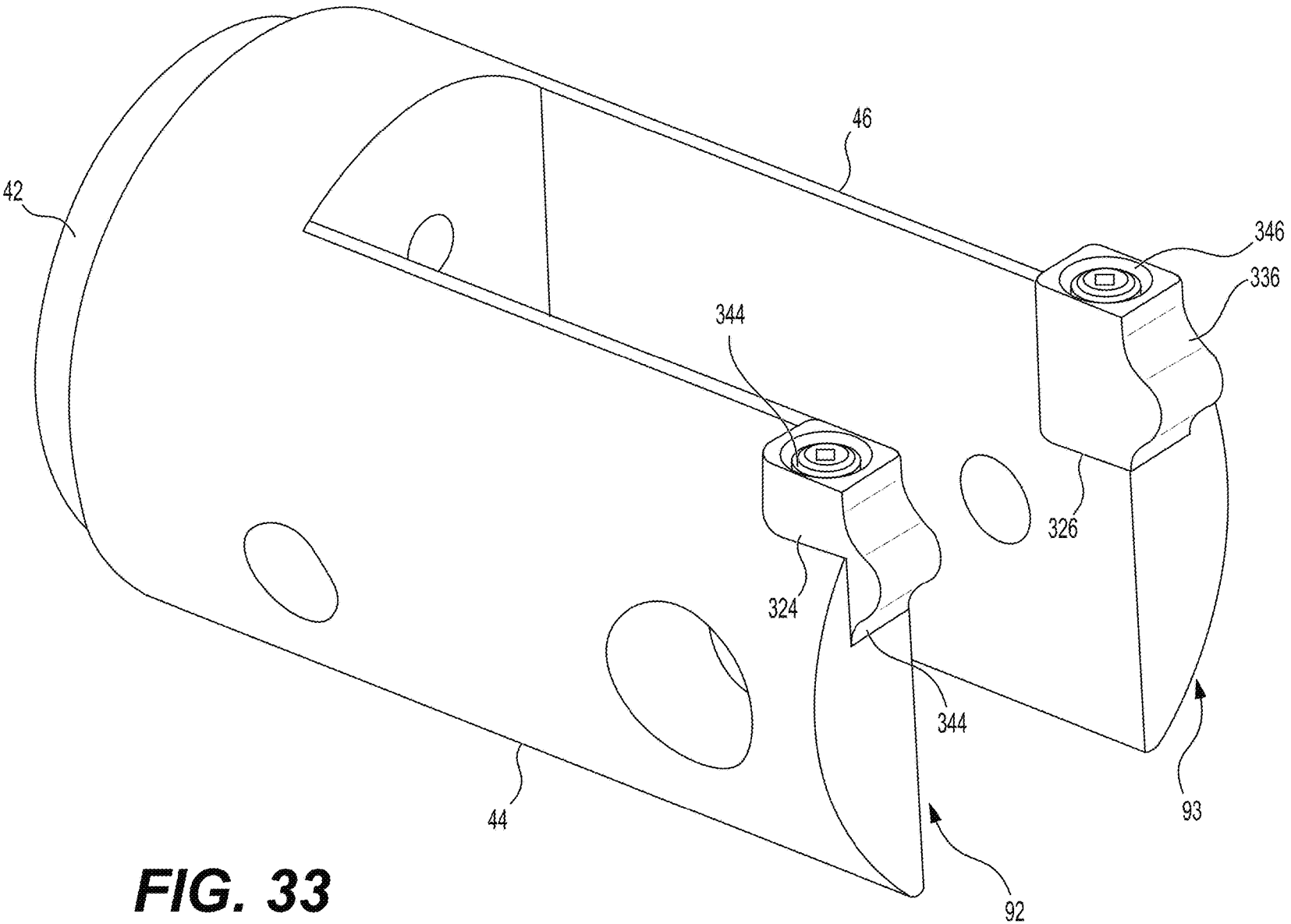
FIG. 33 shows a top, right front view of another embodiment of an automatic loading system having first fork 44 and second fork with mountings and allowing separate cam lobes and to be mounted thereto.

FIG. 33 shows another embodiment of an automatic loading system having first fork 44 and second fork 46 with mountings 324 and 326 allowing separate cam lobes 334 and 336 to be mounted thereto by way of, for example, and without limitation separate fasteners 344 and 346. This can be done for a variety of purposes. In embodiments, separate fasteners 344 and 346 can be made from a different material than first fork 44 and second fork 46 such as by providing a material with greater hardness. Additionally, in embodiments mountings 324 and 326 can be adapted to mount to separate cam lobes 334 and 336 each supporting surfaces intended to interact with bolt positioner 78. These separate cam lobes 334 and 336 can be positioned within a range of different positions along cam surfaces 92 and 93. In one such embodiment the ability to mount cam lobes 334 and 336 within a range of different positions can be used to help align cam lobes 334 and 336.

The ability to mount cam lobes 334 and 336 within a range of different positions can be used to allow cam lobes 334 and 336 to positioned within a first range of positions when tube end 42, first fork 44 and second for 46 are used with a first airgun design and to be positioned in a second range of positions when tube end 42, first fork 44 and second for 46 are used with a second airgun design.

Figure 34:
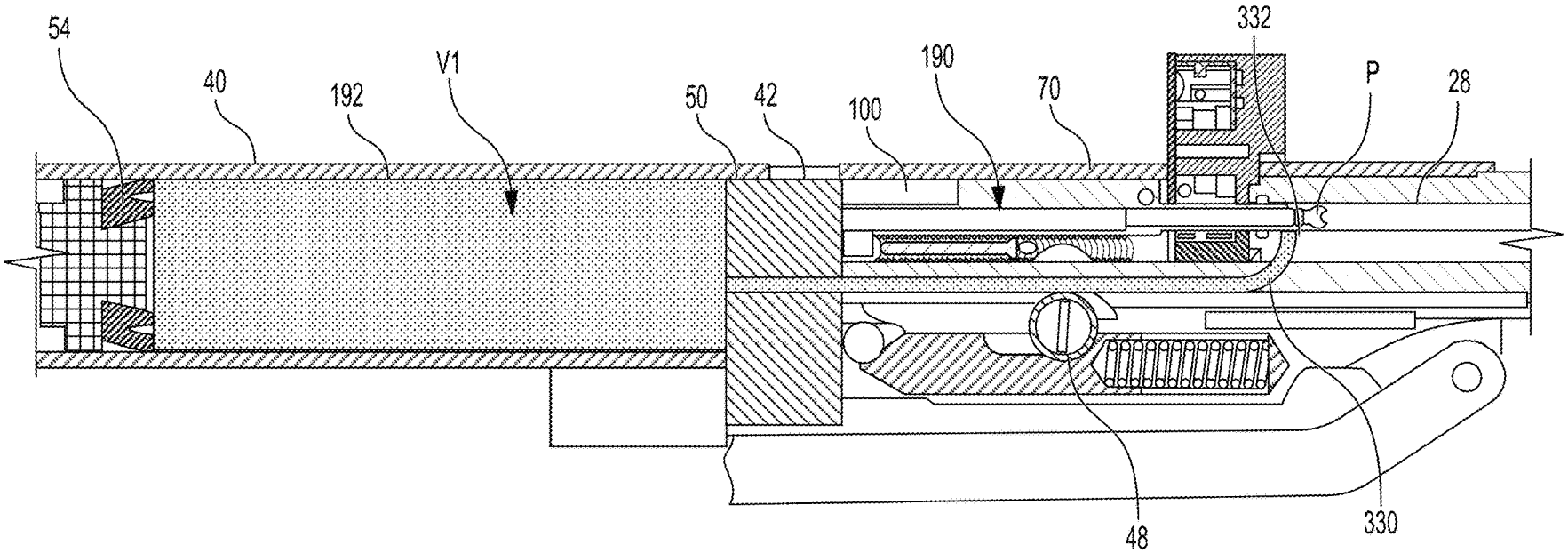
FIG. 34 shows a schematic cross section view of another embodiment of an automatic loading system with an air management system that does not pass through a bolt.

FIG. 34 shows another embodiment of automatic loading system 60 having a pressure system 190 that does not pass through bolt 100. In this embodiment, a secondary air path 330 is provided extending from compression tube 40 to an opening 332 in or proximate to bore 28 or between bolt 100 and projectile P. In embodiments, bolt leader 116 may be adapted or shaped to help guide pressurized air to projectile P.

What is claimed is:

1. An airgun comprising:

a compression tube including a transfer port;

a bolt including a leader portion sized to pass into a projectile supply passageway of a projectile supply;

a bolt positioner that moves with the bolt;

a breech configured to hold the projectile supply such that the projectile supply passageway is substantially in line with a bore of a barrel, wherein the breech includes a bolt guide that is configured to position the bolt between the compression tube and the breech for movement along a path that is substantially co-axial with the projectile supply passageway and the bore;

a bolt positioner guide positioned to interact with the bolt positioner to advance the bolt between (i) a first position extending through the projectile supply passageway and (ii) a second position retracted from the projectile supply passageway;

a first pivot coupling the breech to the compression tube, the first pivot configured for movement between (i) a firing position and (ii) a reloading position;

a cam surface configured to move with the compression tube when the compression tube is rotated relative to the breech; and a gas flow path disposed between (i) the transfer port and (ii) a firing location in the bore, wherein the cam surface and the bolt positioner are configured such that rotation of the breech from the firing position to the reloading position causes the cam surface to drive the bolt positioner, against a biasing member, from the first position to the second position to open the projectile supply passageway, and wherein the cam surface and the bolt positioner are configured such that rotation of the breech from the firing position to the reloading position causes the cam surface to drive the bolt positioner through the projectile supply passageway to drive a projectile in the projectile supply passageway to a position where a release of pressurized gas in the firing location is configured to thrust the projectile through the bore.

2. The airgun of claim 1, wherein the biasing member comprises a compression spring.

3. The airgun of claim 1, wherein the biasing member comprises one of a mechanical spring, a gas spring, an arrangement of one or more magnets or electromagnets, or an elastically expanding material.

4. The airgun of claim 1, further comprising:

an alignment rod positioned within a biasing member path.

5. The airgun of claim 1, wherein the projectile supply comprises a plurality of projectile holders.

6. The airgun of claim 5, wherein the projectile supply further comprises a carousel configured to rotate about a second pivot.

7. The airgun of claim 5, wherein the projectile supply further comprises a magazine projectile supply.

8. The airgun of claim 7, wherein the magazine projectile supply comprises a cover configured to prevent projectiles loaded in the projectile holders from exiting the projectile holders on one side of the projectile holders.

9. An airgun comprising:

a compression tube including separated forks;

a first pivot extending across the separated forks and a tube fork cam surface;

a magazine positioner adapted to hold a magazine such that a magazine projectile supply is positioned in a loading area between (i) a tube fork side of the magazine positioner and (ii) a bore side of the magazine positioner;

a breech pivotally mounted to the separated forks for movement at least between (i) a closed orientation with the compression tube proximate the breech and (ii) an open orientation, wherein the breech includes a barrel holder positioning a barrel opening on a barrel side of the magazine positioner and having a bolt guide on a bolt guide side of the magazine projectile supply;

a bolt configured to interact with the bolt guide such that a contact surface of the bolt is urged between (i) a loading position on a bolt side of the magazine projectile supply and (ii) a firing position on the barrel side of the magazine projectile supply, wherein the bolt includes a bolt positioner, wherein a position of the bolt positioner determines a first position of the contact surface; and a biasing system configured to urge a drive surface against the tube fork cam surface;

wherein the tube fork cam surface is configured to interact with a drive bolt positioner to move the bolt such that when the compression tube and the breech are rotated from a closed position to an open position, the contact surface is moved from the firing position through the magazine projectile supply to the loading position, and wherein the tube fork cam surface is further configured to interact with the bolt positioner to move the bolt such that when the compression tube and the breech are rotated from the open position to the closed position, the contact surface is moved from the loading position through a projectile holder of a magazine in the magazine projectile supply to drive a projectile in the projectile holder to a second position where compressed gas from a transfer tube travels through a gas management system to thrust the projectile through a bore.

10. The airgun of claim 9, wherein the biasing system comprises a compression spring.

11. The airgun of claim 9, wherein the biasing system comprises one of a mechanical spring, a gas spring, an arrangement of one or more magnets or electromagnets, or an elastically expanding material.

12. The airgun of claim 9, wherein the biasing system comprises an alignment rod positioned within a biasing member path of the biasing system.

13. The airgun of claim 9, further comprising:

a projectile supply comprising the magazine projectile supply and a plurality of projectile holders.

14. The airgun of claim 13, wherein the projectile supply further comprises a carousel configured to rotate about a second pivot.

15. The airgun of claim 13, wherein the magazine projectile supply comprises a cover configured to prevent projectiles loaded in the projectile holders from exiting the projectile holders on one side of the projectile holders.

* * * * *